United States Patent [19]

Fujimoto et al.

[11] Patent Number: 4,985,347

[45] Date of Patent: Jan. 15, 1991

[54] METHOD FOR PROCESSING SILVER HALIDE COLOR PHOTOGRAPHIC MATERIALS COMPRISING THE USE OF SPECIFIC BLEACHING AGENTS AND HYDROXYLAMINES

[75] Inventors: Hiroshi Fujimoto; Morio Yagihara; Takatoshi Ishikawa, all of Kanagawa, Japan

[73] Assignee: Fuji Photo Film Co., Ltd., Kanagawa, Japan

[21] Appl. No.: 560,493

[22] Filed: Jul. 25, 1990

Related U.S. Application Data

[63] Continuation of Ser. No. 171,363, Mar. 21, 1988, abandoned.

[30] Foreign Application Priority Data

Mar. 19, 1987 [JP] Japan ..... 62-65115

[51] Int. Cl.[5] ..... G03C 7/00; G03C 7/42

[52] U.S. Cl. ..... 430/393; 430/430; 430/434; 430/460; 430/464; 430/467; 430/490; 430/491

[58] Field of Search ..... 430/393, 460, 430, 434, 430/464, 467, 490, 491, 380

[56] References Cited

U.S. PATENT DOCUMENTS

| | | | |
|---|---|---|---|
| 4,518,680 | 5/1985 | Koboshi et al. | 430/393 |
| 4,714,647 | 1/1988 | Abe et al. | 430/385 |
| 4,745,047 | 5/1988 | Asami et al. | 430/467 |
| 4,769,312 | 9/1988 | Kishimoto et al. | 430/384 |
| 4,774,167 | 9/1988 | Koshimizu et al. | 430/380 |
| 4,774,169 | 9/1988 | Kuse et al. | 430/393 |
| 4,818,664 | 4/1989 | Ueda et al. | 430/430 |
| 4,853,318 | 8/1989 | Fujita et al. | 430/464 |
| 4,933,266 | 1/1990 | Stephen et al. | 430/393 |

FOREIGN PATENT DOCUMENTS 1392163 4/1975 United Kingdom .

OTHER PUBLICATIONS

Research Disclosure 24023, Apr. 1984.

*Primary Examiner*—Richard L. Schilling
*Assistant Examiner*—Patrick Doody
*Attorney, Agent, or Firm*—Sughrue, Mion, Zinn, Macpeak & Seas

[57] ABSTRACT

A method for processing silver halide color photographic material is disclosed which comprises processing a silver halide color photographic material with a color developer containing substantially no sulfite ion and then processing the color photographic material with a solution having bleaching capability containing an aminopolycarboxylic acid having a molecular weight of at least 300.

12 Claims, No Drawings

METHOD FOR PROCESSING SILVER HALIDE COLOR PHOTOGRAPHIC MATERIALS COMPRISING THE USE OF SPECIFIC BLEACHING AGENTS AND HYDROXYLAMINES

This is a continuation of application Ser. No. 07/171,363, filed Mar. 21, 1988, now abandoned

FIELD OF THE INVENTION

This invention relates to a method for processing silver halide color photographic materials, and more particularly to the photographic processing of color photographic materials where the desilvering time is shortened

BACKGROUND OF THE INVENTION

After color development, silver halide color photographic material is subjected to a desilvering step. Recently, to shorten the delivery time of finished products and decrease laboratory work, it has been desired to shorten the processing time for color photographic materials and, in this case, shortening of the desilvering step is particularly important.

To shorten the desilvering step, the act has investigated shortening not only the two bath type bleaching and fixing steps but also the monobath type blixing (bleach-fixing) step and further the combination of a fixing step and a blixing step or a bleaching step and blixing step. These techniques are generally called bleaching acceleration techniques and fixing acceleration techniques but investigations on the former technique have been a major focus in the art. In particular, investigations have been made on bleaching accelerators.

Practical examples of these bleaching accelerators are compounds having a mercapto group or a disulfide group as described in U.S. Pat. No. 3,893,858, West German Patents 1,290,812 and 2,059,988, Japanese Patent Applications (OPI) 32736/78, 57831/78, 37418/78, 65732/78, 72623/78, 95630/78, 95631/78, 104232/78, 124424/78, 141623/78, and 28426/78 (the term "OPI" as used herein means an "unexamined published Japanese Patent application"), Research Disclosure, RD No. 17129 (July, 1978), etc.; thiazoline derivatives as described in Japanese Patent Application (OPI) No. 140129/75; thiourea derivatives as described in Japanese Patent Publication 8506/70, Japanese Patent Applications (OPI) 20832/77 and 32735/78, U.S. Pat. No. 3,706,516, etc.; iodides as described in West German Patent No. 1,127,715 Japanese Patent Application (OPI) 16235/83; polyethylene oxides as described in West German Patent Nos. 966,410 and 2,748,430; polyamine compounds as described in Japanese Patent Publication 8836/70; and other compounds as described in Japanese Patent Applications(OPI) 42434/74, 59644/74, 94927/78, 35727/79, 26506/80, and 163940/83.

Compounds having a high accelerating effect are rather rare among the aforesaid compounds and, in particular, compounds having a mercapto group or a disulfide group are preferred from the view point of showing a high accelerating effect and, particularly, the compounds described in U.S. Pat. No. 3,893,858, West German Patent No. 1,290,812, and Japanese Patent Application (OPI) 95630/78 are preferred.

However, since these compounds have the disadvantages that they are liable to be air oxidized and further are liable to cause poor fixing, techniques using these compounds are not yet satisfactory.

Techniques using iron (III) complexes of various aminopolycarboxylic acids having a molecular weight of 300 or more as bleaching agents to accelerate bleaching are described in *Research Disclosure,* RD No. 24023, (April, 1984), Japanese Patent Applications (OPI) 5335/74, 67657/75, 149358/84, 47959/86, 50146/86, 50147/86, etc.

However, when such an iron(III) complex of an aminopolycarboxylic acid having a molecular weight of 300 or more is used as a bleaching agent, the bleaching rate is increased similar to using a bleaching agent having a molecular weight of less than 300, but the effect is still insufficient.

An object of this invention is, therefore, to provide a processing technique for silver halide color photographic materials where the desilvering time is greatly shortened.

SUMMARY OF THE INVENTION

As a result of various investigations, the inventors have discovered that the aforesaid object can be attained by the method of this invention as set forth hereinbelow.

That is, according to this invention, there is provided a method for processing silver halide color photographic materials, which comprises processing a silver halide color photographic material with a color developer containing substantially no sulfite ion and, and then, processing the color photographic material with a solution having bleaching capability containing an aminopolycarboxylic acid having a molecular weight of at least 300.

As described hereinbefore, by using a bleaching agent composed of an aminopolycarboxylic acid having a molecular weight of at least 300, the bleaching rate is increased to some extent. However, in this case, the desilvering time is greatly shortened by using a color developer containing substantially no sulfite ion in the preceding color development (i.e., the desilvering time of the present invention is from about 0.99 to 0.5 times that due to a conventional method ). The reason for this is not yet been clear, but it is believed to be based on the form of the developed silver formed during the color development. It is quite unexpected that the combination of such a color developer composition and such a desilvering solution can greatly shorten the desilvering time.

When a color developer contains substantially no sulfite ion, the stability of the solution is sometimes reduced by air-oxidation and the tendency is particularly remarkable in continuous processing. In such case, this problem can be overcome by using a floating lid for reducing the air-liquid contact area (i.e., reducing area in which air and a processing solution are contacted) or by using an organic preservative.

DETAILED DESCRIPTION OF THE INVENTION

The aminopolycarboxylic acids having a molecular weight of at least 300 for use in this invention will now be described in detail.

The aminopolycarboxyic acids in this invention are used as a bleaching agent in the form of iron(III) complexes thereof. The aminopolycarboxylic acid may be used as a previously formed iron(III) complex thereof or an aminopolycarboxylic acid iron(III) complex may be formed in a processing solution by separately adding an aminopolycarboxylic acid and a ferric salt (e.g., ferric chloride, ferric sulfate, ferric nitrate, and ferric phosphate).

In general, it is preferred from the viewpoint of bleaching power that the molar ratio of the aminopolycarboxylic acid to iron in the aminopolycarboxylic acid iron (III) complex is as large as possible. These iron complexes may further form salts with sodium, potassium, lithium, ammonium, etc.

Specific examples of the aminopolycarboxylic acids for use in this invention are illustrated below, although the invention is not limited to these compounds.

| | | Molecular weight |
|---|---|---|
| A-1 | Diethylenetriaminepentaacetic Acid | 393 |
| A-2 | Cyclohexanetetraacetic Acid | 364 |
| A-3 | Glycol Ether Diaminetetraacetic Acid | 380 |
| A-4 | 1,3-Diaminopropanetetraacetic Acid | 306 |
| A-5 | Diaminopropanolpentaacetic Acid | 322 |
| A-6 | Ethylenediaminediortho-hydroxy-phenylacetic Acid | 360 |
| A-7 | 1,2-Diaminopropanetetraacetic Acid | 306 |
| A-8 | Triethylenetetraminehexaacetic Acid | 494 |

Of the above-described compounds, compounds A - 2, A - 3, A - 4, and A - 7 are particularly preferred from the viewpoint of showing excellent bleaching power.

The amount of the aforesaid compound added to a processing solution is preferably from 0.01 mol to 1.0 mol, and more preferably from 0.04 mol to 0.5 mol, per liter of the processing solution. The aforesaid compounds may be used alone or in combination. Furthermore, the aforesaid aminopolycarboxylic acid may be used together with an aminopolycarboxylic acid having a molecular weight of less than 300 to the extent of not reducing the effect of this invention. A ratio of the aforesaid aminopolycarboxylic acid having a molecular weight of less than 300 / the aminopolycarboxylic acid having a molecular weight of 300 or more is preferably from 5/1 to 0/1 and more preferably from 1/1 to 0/1.

The preferred molecular weight of the aminopolycarboxylic acid for use in this invention is from 300 to 800 and particularly from 300 to 400.

The term "containing substantially no sulfite ion" in this invention means that the processing solution does not contain sulfite ion or may contain sulfite ion to the extent of not having a harmful influence on photographic properties and practically means that the processing solution (e.g., a color developer) contains from 0 to 0.005 mol/liter, and preferably from 0 to 0.002 mol/liter of the developer of sulfite ion.

It is preferred, from the viewpoints of further improving the desilvering property and preventing the increase of stain after processing, that the color developer for use in this invention contains substantially no benzyl alcohol. The term "contains substantially no benzyl alcohol" means that the color developer contains 5.0 ml or less, and preferably 2 ml or less, of benzyl alcohol per liter of the color developer, and more preferably the color developer contains no benzyl alcohol.

As described hereinbefore, the color developer in this invention may contain an organic preservative for preventing the reduction of stability due to air-oxidation. The organic preservative is an organic compound which reduces the deteriorating rate of an aromatic primary amine color developing agent by being incorporated in the developing solution for color photographic materials, i.e., the organic preservative is an organic compounds having the function of preventing the oxidation of the color developing agent by air, etc. Examples of the particularly effective organic preservatives include hydroxylamines, hydroxamic acids, hydrazines, hydrazides, phenols, α-hydroxyketones, α-aminoketones, saccharide, monoamines, diamines, polyamines, quaternary ammonium salts, nitroxyradicals, alcohols, oximes, diamide compounds, condensed cyclic amines, etc. These compounds are described in Japanese Patent Applications 198987/86, 201861/86, 186559/86, 197760/86, and 188742/86 (corresponding to U.S. Patent Application Ser. No. 76505 and European Patent Application No. 254,280), U.S. Pat. Nos. 3,615,503 and 2,494,903, Japanese Patent Application (OPI) 143020/77, 30845/88, 21647/88, 44655/88, 43140/88, 44657/88, and 44656/88, Japanese Patent Publication 30496/73, etc.

The aforesaid preferred organic preservatives for use in this invention are now shown by general formulae and specific examples, but the invention is not limited thereto.

The amount of the organic preservative added to the color developer is from 0.005 mol to 0.5 mol/liter, and preferably from 0.03 mol to 0.1 mol/liter.

Examples of preferred hydroxylamines are those shown by formula (I)

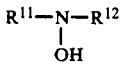

(I)

wherein $R^{11}$ and $R^{12}$ each represents a hydrogen atom, an unsubstituted or substituted alkyl group, an unsubstituted or substituted alkenyl group, an unsubstituted or substituted aryl group, or a heteroaromatic group. $R^{11}$ and $R^{12}$ are not, however, simultaneously a hydrogen atom, and they may combine with each other to form a heterocyclic ring (i.e., a 5-membered to a 8-membered ring) together with the nitrogen atom.

When $R^{11}$ and $R^{12}$ are an alkyl group or an alkenyl group, the carbon atom number for $R^{11}$ and $R^{12}$ is preferably from 1 to 10, more preferably from 1 to 5.

Examples of the nitrogen-containing heterocyclic ring formed by the combination of $R^{11}$ and $R^{12}$ are a piperidyl group, a pyrrolidinyl group, an N-alkylpiperadyl group, a morpholyl group, an indolinyl group, a benzotriazole group, etc.

The alkyl group, alkenyl group, and aryl group represented by $R^{11}$ and $R^{12}$ may have substituents. Preferred examples of the substituents include a hydroxyl group, an alkoxy group, an alkylsulfonyl group, an arylsulfonyl group, an amide group, a carboxyl group, a cyano group, a sulfo group, a nitro group and an amino group.

Specific examples of the compounds represented by formula (I) are as follows.

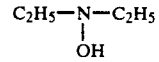

I-1

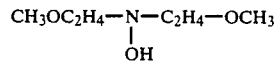

I-2

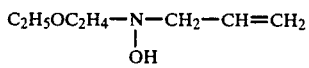

I-3

-continued

I-4

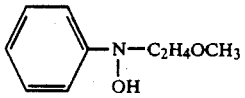

I-5

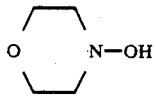

I-6

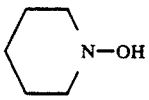

I-7

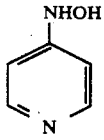

I-8

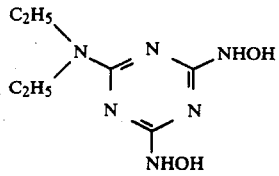

I-9

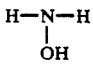

Specific examples of preferred hydraxamic acids are those represented by formula (II)

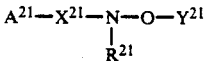

(II)

wherein $A^{21}$ represents a hydrogen atom, a substituted or unsubstituted alkyl group, a substituted or unsubstituted aryl group, a substituted or unsubstituted amino group, a substituted or unsubstituted heterocyclic group, a substituted or unsubstituted alkoxy group, a substituted or unsubstituted aryloxy group, a substituted or unsubstituted carbamoyl group, a substituted or unsubstituted sulfamoyl group, an acyl group, a carboxyl group, a hydroxyamino group, or a hydroxyaminocarbonyl group. Examples of the aforesaid substituent are a halogen atom, an aryl group, an alkyl group, and an alkoxy group.

$A^{21}$ is preferably a substituted or unsubstituted alkyl group, a substituted or unsubstitued aryl group, a substituted or unsubstituted amino group, a substituted or unsubstituted alkoxy group or a substituted or unsubstituted aryloxy group, and particularly preferably a substituted or unsubstituted amino group, a substituted or unsubstituted alkoxy group or a substituted or unsubstituted aryloxy group. The carbon atom number of the group represented by $A^{21}$ is preferably from 1 to 10.

$X^{21}$ in formula (II) described above represents

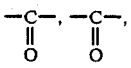

$—SO_2—$, or —SO—, and is preferably

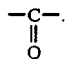

$R^{21}$ in formula (II) represents a hydrogen atom, a substituted or unsubstituted alkyl group, or a substituted or unsubstituted aryl group (preferably, the carbon atom number for $R^{21}$ is from 1 to 10.), and $A^{21}$ and $R^{21}$ may combine with each other to form a ring structure. The substituent for the group represented by $R^{21}$ is the same as those shown above for $A^{21}$. $R^{21}$ is preferably a hydrogen atom.

$Y^{21}$ in formula (II) represents a hydrogen atom or a group capable of becoming hydrogen atom by a hydrolysis reaction.

Specific examples of the compound represented by formula (II) are illustrated below.

II-1

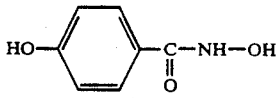

II-2

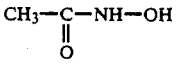

II-3

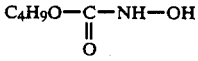

II-4

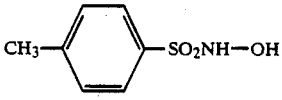

II-5

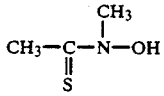

II-6

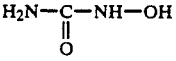

Specific example of preferred hydrazines and hydrazides are those represented by formula (III)

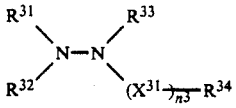

(III)

wherein $R^{31}$, $R^{32}$, and $R^{33}$ each represents a hydrogen atom, a substituted or unsubstituted alkyl group, a substituted or unsubstituted aryl group or a substituted or unsubstituted heterocyclic group; $R^{34}$ represents a hydroxyl group, a hydroxyamino group, a substituted or unsubstituted alkyl group, a substituted or unsubstituted aryl group, a substituted or unsubstituted heterocyclic group, a substituted or unsubstituted alkoxy group, a substituted or unsubstituted aryloxy group, a substituted or unsubstituted carbamoyl group, or a substituted or unsubstituted amino group; $X^{31}$ represents —CO—, —SO—, or $$-\overset{\overset{\displaystyle NH}{\|}}{C}-;$$

and $n^3$ represents 0 or 1. In particular, when $n^3$ is 0, $R^{34}$ represents such an alkyl group, an aryl group, or a heterocyclic group. Also, $R^{33}$ and $R^{34}$ may together form a heterocyclic ring. Preferably the carbon atom number for $R^{31}$, $R^{32}$, $R^{33}$ and $R^{34}$ is from 1 to 10.

The preferred substituents for $R^{31}$, $R^{32}$, $R^{33}$ and $R^{34}$ include a —OH group, a —COOH group, a $-SO_3H$ group, etc.

In formula (III), it is preferred that $R^{31}$, $R^{32}$, and $R^{33}$ are a hydrogen atom or an alkyl group and also it is particularly preferred that $R^{31}$ and $R^{32}$ are a hydrogen atom.

Also, in formula (III), it is preferred that $R^{34}$ is such an alkyl group, an aryl group, an alkoxy group, a carbamoyl group, or an amino group. Also, $X^{31}$ is preferably —CO—or $-SO_2-$, and is most preferably —CO—.

Specific examples of the compounds represented by formula (III) are illustrated below.

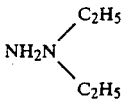

(III-1)

$NH_2NH(CH_2)_4SO_3H$ (III-2)

$NH_2NH(CH_2)_2OH$ (III-3)

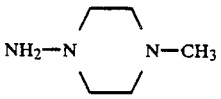

(III-4)

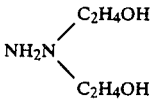

(III-5)

$NH_2NHCOCH_3$ (III-6)

$NH_2NHCOOC_2H_5$ (III-7)

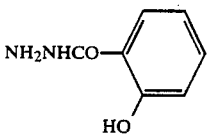

(III-8)

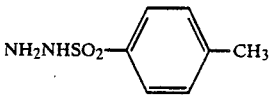

(III-9)

$NH_2NHCONH_2$ (III-10)

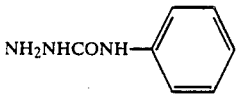

(III-11)

$NH_2NHSO_3H$ (III-12)

$$NH_2NH\overset{\overset{\displaystyle NH}{\|}}{C}NH_2$$ (III-13)

-continued $NH_2NHCOCONHNH_2$ (III-14)

Examples of preferred phenols are those represented by formula (IV)

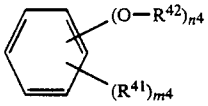

(IV)

wherein $R^{41}$ represents a hydrogen atom, a halogen atom, an alkyl group, an aryl group, an alkoxy group, an aryloxy group, a carboxyl group, a sulfo group, a carbamoyl group, a sulfamoyl group, an amido group, a sulfonamido group, a ureido group, an alkylthio group, an arylthio group, a nitro group, a cyano group, an amino group, a formyl group, an acyl group, a sulfonyl group, an alkoxycarbonyl group, an aryloxycarbonyl group, an alkoxysulfonyl group, or an aryloxysulfonyl group. The groups represented by $R^{41}$ may have one or more substituents and examples of the substituent(s) include a halogen atom, an alkyl group, an aryl group, a hydroxyl group, an alkoxy group, etc.

When $m^4$ is 2 or more (that is, when 2 or more of $R^{41}$ are present), the $R^{41}$ may be the same or different and when they are adjacent to each other, they may combine with each other to form a 5-membered or 6-membered ring composed of carbon atoms, hydrogen atoms, halogen atoms, oxygen atoms, nitrogen atoms, sulfur atoms, etc., and the ring may be saturated or unsaturated.

$R^{42}$ in formula (IV) represents a hydrogen atom or a group capable of being hydrolyzed and $m^4$ and $n^4$ each represents an integer of from 1 to 5.

In formula (IV), $R^{41}$ is preferably an alkyl group, a halogen atom, an alkoxy group, an alkylthio group, a carboxyl group, a sulfo group, a carbamoyl group, a sulfamoyl group, an amino group, an amido group, a sulfonamido group, a nitro group, or a cyano group, and particularly preferably is an alkoxy group, an alkylthio group, an amino group, or a nitro group. Also, it is more preferred that $R^{41}$ is at an ortho position or a para position to (O-$R^{42}$). Furthermore, the carbon atom number of the group represented by $R^{41}$ is preferably from 1 to 10, and particularly preferably from 1 to 6.

In formula (IV), $R^{42}$ is preferably a hydrogen atom or a hydrolyzable group having from 1 to 5 carbon atoms. Also, when $n^4$ is 2 or more, it is more preferred that the $OR^{42}$ groups are ortho or para to each other.

Specific examples of the compounds represented by formula (IV) are illustrated below.

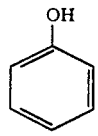

IV-1

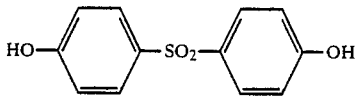

IV-2

-continued

IV-3

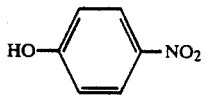

IV-4

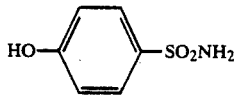

IV-5

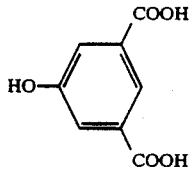

IV-6

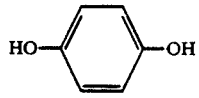

IV-7

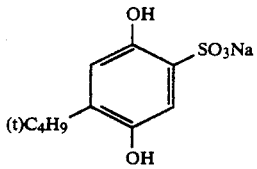

IV-8

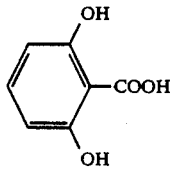

IV-9

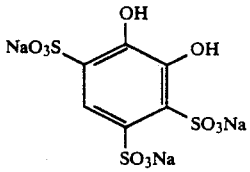

IV-10

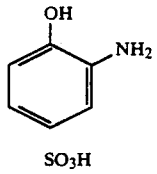

IV-11

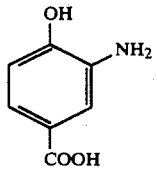

Examples of the preferred α-hydroxyketones and α-aminoketones are those represented by formula (V)

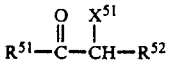

(V)

wherein $R^{51}$ represents a hydrogen atom, a substituted or unsubstituted alkyl group, a substituted or unsubstituted aryl group, a substituted or unsubstituted alkoxy group, a substituted or unsubstituted aryloxy group or a substituted or unsubstituted amino group $R^{52}$ represents a hydrogen atom, a substituted or unsubstituted alkyl group or a substituted or unsubstituted aryl group; $R^{51}$ and $R^{52}$ may also form together a carbon ring or a heterocyclic ring; and $X^{51}$ represents a hydroxy group or a substituted or unsubstituted amino group. Preferably, the carbon atom mumber for $R^{51}$ and $R^{52}$ is from 1 to 10. The preferred substituents for $R^{51}$ and $R^{52}$ include a —OH group, a —COOH group, a —SO H group, etc.

In formula (V), $R^{51}$ is preferably a hydrogen atom, an alkyl group, an aryl group, or an alkoxy group and $R^{52}$ is preferably a hydrogen atom or an alkyl group.

Specific examples of the compounds represented by formula (V) are illustrated below.

(V-1)

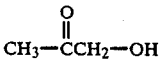

(V-2)

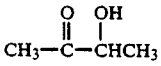

(V-3)

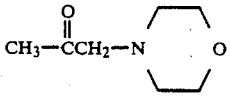

(V-4)

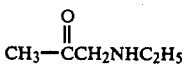

(V-5)

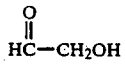

(V-6)

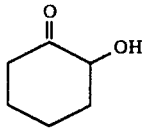

(V-7)

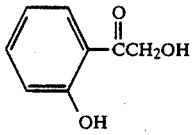

(V-8)

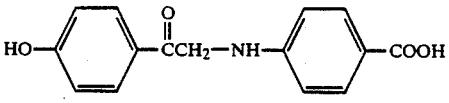

(V-9)

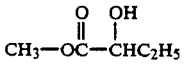

(V-10)

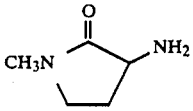

A saccharide is also a preferred organic preservative.

A saccharide (also called a carbohydrate) includes monosaccharides and polysaccharides and is generally represented by $C_nH_{2m}O_m$. A monosaccharide generally calls aldehydes or ketones of polyhydric alcohols (called aldose and ketose, respectively) and various derivatives such as reduced derivatives, oxidized derivatives and dehydrated derivatives, of aldehydes or ketones of polyhydric alcohols, amino sugar, thio sugar, etc. A polysaccharide is the product formed by the dehydration condensation of two or more of monosaccharides as described above.

Preferred examples of these saccharides are aldoses having an aldehyde group and derivatives thereof, and monosaccharides corresponding to the aforesaid preferred saccharides are particularly preferred.

Examples of the preferred saccharide are illustrated below.

D-oxylose VI-1

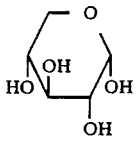

L-arabinose VI-2

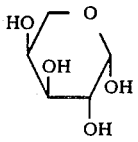

D-ribose VI-3

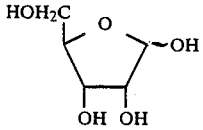

D-deoxyribose VI-4

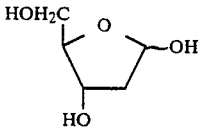

D-glucose VI-5

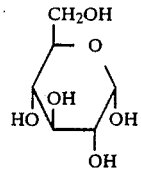

D-galactose VI-6

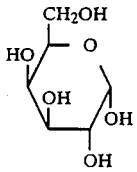

D-mannose VI-7

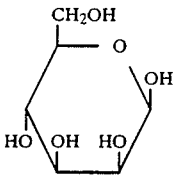

Glucosamine VI-8

-continued

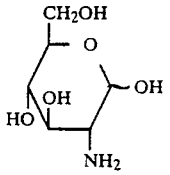

L-sorbose VI-9

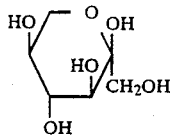

D-sorbite (solbitor) VI-10

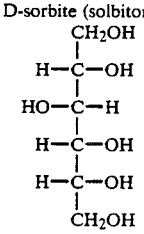

Specific examples of preferred monoamines are those represented by formula (VII)

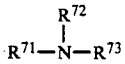

(VII)

wherein $R^{71}$, $R^{72}$, and $R^{73}$ each represents a hydrogen atom, an alkyl group, an alkenyl group, an aryl group, an aralkyl group, or a heterocyclic group. $R^{71}$ and $R^{72}$, $R^{71}$ and $R^{73}$, or $R^{72}$ and $R^{73}$ may combine with each other to form a nitrogen-containing heterocyclic ring. Preferably, the carbon atom number for $R^{71}$, $R^{72}$ and $R^{73}$ is from 1 to 10.

The groups represented by $R^{71}$, $R^{72}$, and $R^{73}$ may be substituted. The preferred substituents for $R^{71}$, $R^{72}$ and $R^{73}$ include a -OH group, a -COOH group, a $-SO_3H$ group, etc. $R^{71}$, $R^{72}$, and $R^{73}$ are particularly preferably a hydrogen atom or an alkyl group.

Specific examples of the compounds represented by formula (VII) are illustrated below.

$N(CH_2CH_2OH)_3$ VII-1

$H_2NCH_2CH_2OH$ VII-2

$HN(CH_2CH_2OH)_2$ VII-3

$C_7H_{15}N(CH_2CH(OH)CH_2OH)_2$ VII-4

VII-5

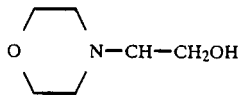

VII-6

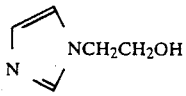

VII-7

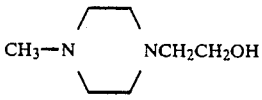

-continued

VII-8

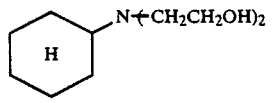

VII-9

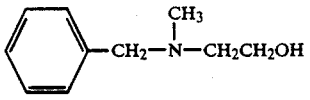

VII-10 $(HOCH_2CH_2)_2NCH_2CH_2SO_2CH_3$

VII-11 $HN(CH_2COOH)_2$

VII-12 $HOOCCH_2CH_2CH(NH_2)COOH$

VII-13 $H_2NCH_2CH_2SO_2NH_2$

VII-13

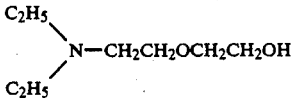

VII-14 $H_2N—C(CH_2OH)_2$

VII-15 $HOCH_2CH(NH_2)COOH$

VII-16

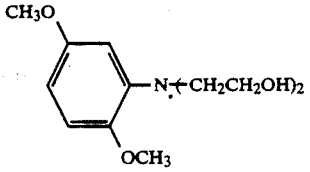

VII-17

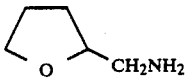

VII-18

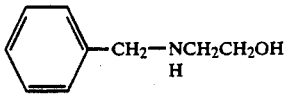

VII-19

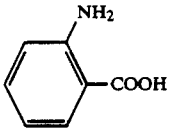

Examples of preferred diamines are those represented by formula (VIII)

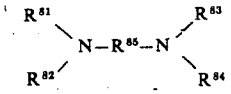

wherein $R^{81}$, $R^{82}$, $R^{83}$, and $R^{84}$ each represents a hydrogen atom, an alkyl group, an alkenyl group, an aryl group, an aralkyl group, or a heterocyclic group (preferably, the carbon atom number for $R^{81}$, $R^{82}$, $R^{83}$ and $R^{84}$ is from 1 to 10) and $R^{85}$ represents a divalent organic group such as an alkylene group, an arylene group, an aralkylene group, an alkenylene group, or a heterocyclic group (preferably, the carbon atom number for R85 is from 1 to 10).

$R^{81}$, $R^{82}$, $R^{83}$, $R^{84}$ and $R^{85}$ may have substituents such as a —OH group, a —COOH group, a —SO H group, etc.

$R^{81}$, $R^{82}$, $R^{83}$, and are preferably a hydrogen atom or an alkyl group and $R^{85}$ is preferably an alkylene group.

Specific examples of the compound represented by formula (VIII) are illustrated below.

VIII-1

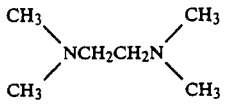

VIII-2 $(HOCH_2CH_2)_2NCH_2CH_2N(CH_2CH_2OH)_2$

VIII-3

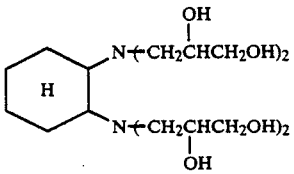

VIII-4 $H_2NCH_2CH_2N(CH_2CH_2OH)_2$

VIII-5 $H_2NCH_2CH(OH)CH_2NH_2$

VIII-6

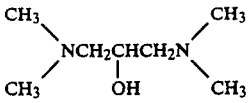

VIII-7

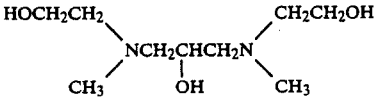

VIII-8

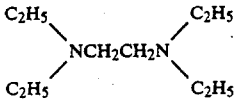

VIII-9

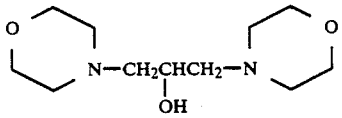

VIII-10

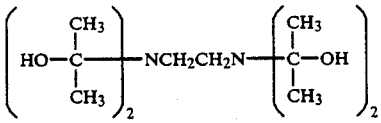

VIII-11

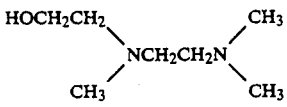

Examples of preferred polyamines are those represented by formula (IX);

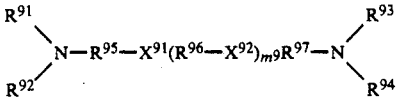

(IX)

wherein $R^{91}$, $R^{92}$, $R^{93}$, and $R^{94}$ each represents a hydrogen atom, an alkyl group, an alkenyl group, an aryl group, an aralkyl group or a heterocyclic group (preferably, the carbon atom number for $R^{91}$, $R^{92}$, $R^{93}$ and $R^{94}$ is from 1 to 10); and $R^{95}$, $R^{96}$, and $R^{97}$ each represents a divalent organic group and is the same as defined above for $R^{85}$ in formula (VIII).

$R^{91}$, $R^{92}$, $R^{93}$ and $R^{94}$ may have substituents such as a —OH group, a —COOH group, a —SO H group, etc.

In formula (IX), $X^{91}$ and $X^{92}$ each represents

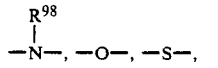

—CO—, —$SO_2$—, —SO—or a linking group which is obtained by a combination of these linking groups, $R^{98}$ is the same as defined above for $R^{91}$, $R^{92}$, $R^{93}$, and $R^{94}$, and $m^9$ represents an integer of 0 or more. There is no particular restriction on the upper limit of $m^9$ and the compounds of formula (IX) may have a high molecular weight if the compounds are water soluble but the preferred range of m9 is usually from 1 to 3.

Specific examples of the compounds shown by formula (IX) are illustrated below.

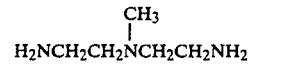

IX-1

$(HOCH_2CH_2)_2NCH_2CH_2OCH_2CH_2N(CH_2CH_2OH)_2$ IX-2

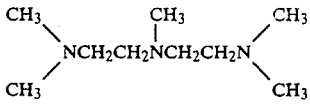

IX-3

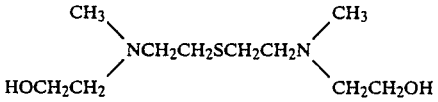

IX-4

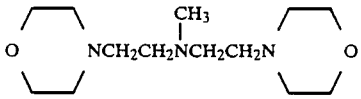

IX-5

$H_2N(CH_2CH_2NH)_nH$ IX-6 n = 500, 20, 000

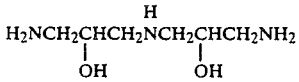

IX-7

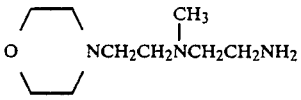

IX-8

Examples of preferred quaternary ammonium salts are those represented by formula (X)

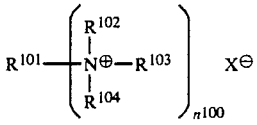

(X)

wherein $R^{101}$ represents an $n^{100}$-valent organic group; $R^{102}$, $R^{103}$, and $R^{104}$ each represents a mono-valent organic group, at least two of $R^{102}$, $R^{103}$, and $R^{104}$ may combine with each other to form a heterocyclic ring containing quaternary ammonium atoms (the number of ammonium atoms represents the same as defined below for $n^{100}$; $n^{100}$ represents an integer of 1 or more; and $X^{\ominus}$ represents an anion such as $Cl^{\ominus}$, $Br^{\ominus}$, $I^{\ominus}$, etc.

A particularly preferred mono-valent group represented by $R^{102}$, $R^{103}$, and $R^{104}$ is a substituted or unsubstituted alkyl group (preferably having from 1 to 10 carbon atoms) and it is most preferred that at least one of $R^{102}$, $R^{103}$, and $R^{104}$ is a hydroxyalkyl group, an alkoxyalkyl group, or a carboxyalkyl group. Also, $n^{100}$ is preferably an integer of from 1 to 3, and more preferably is 1 or 2.

Specific examples of the compounds represented by formula (X) are illustrated below.

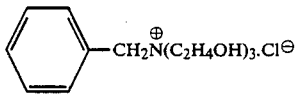

X-1

$C_2H_5N(C_2H_4OH)_3.Cl^{\ominus}$ X-2

$N(C_2H_4OH)_4.Cl^{\ominus}$ X-3

$(C_2H_5)_2N(C_2H_4OH)_2.Cl^{\ominus}$ X-4

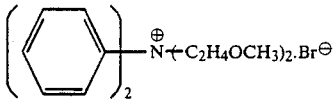

X-5

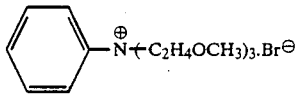

X-6

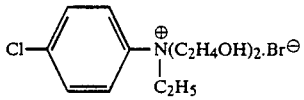

X-7

$(HOC_2H_4)_3N-C_2H_4-N(C_2H_4OH)_3$ X-8

$(HOC_2H_4)_2N(CH_2)_3N(C_2H_4OH)_2$ X-9

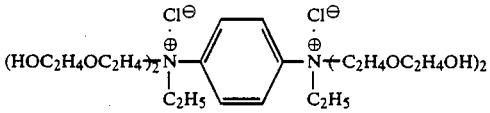

X-10

Examples of preferred nitroxyradicals are those represented by formula (XI)

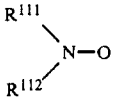

(XI)

wherein $R^{111}$ and $R^{112}$ each represents a hydrogen atom, an alkyl group, an aryl group, or a heterocyclic group. Preferably, the carbon atom number for $R^{111}$ and $R^{112}$ is from 1 to 10.

The alkyl group, aryl group, or heterocyclic group described above may have a substituent and examples of the substituent include a hydroxyl group, an oxo group, a carbamoyl group, an alkoxy group, a sulfamoyl group, a carboxyl group, and a sulfo group.

Examples of the aforesaid heterocyclic group include a pyridyl group and a piperidyl group.

Further, $R^{111}$ and $R^{112}$ are preferably a substituted or unsubstituted aryl group or a tertiary alkyl group (e.g., a t-butyl group).

Specific examples of the compounds represented by formula (XI) are illustrated below.

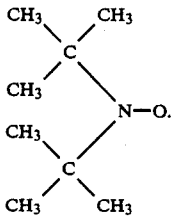

XI-1

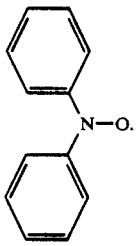

XI-2

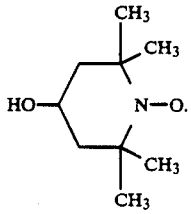

XI-3

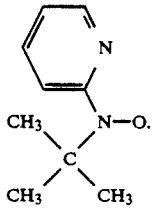

XI-4

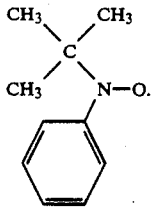

XI-5

Examples of preferred alcohols are those represented by formula (XII)

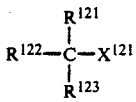

(XII)

wherein $R^{121}$ represents a hydroxy-substituted alkyl group; $R^{122}$ represents an unsubstituted alkyl group or the same group as defined for $R^{121}$; $R^{123}$ represents a hydrogen group or the same group as defined for $R^{122}$; and $X^{121}$ represents a hydroxy group, a carboxyl group, a sulfo group, a nitro group, an unsubstituted or hydroxy-substituted alkyl group, an unsubstituted or substituted amide group or an unsubstituted or substituted sulfonamide group. Preferably, the carbon atom number for $R^{121}$ and $R^{122}$ is from 1 to 10, and $R^{121}$ and $R^{122}$ may have substituents such as a —OH group, a —COOH group, a $—SO_3H$ group etc.

In formula (XII), $R^{121}$ is preferably a hydroxyl group, a carboxyl group, or a hydroxyalkyl group.

Specific examples of the compounds represented by formula (XII) are illustrated below.

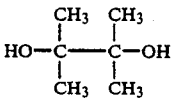

XII-1

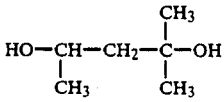

XII-2

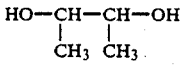

XII-3

$HO—CH(CH_2OH)_2$ XII-4

$(HO—CH_2)_3COOH$ XII-5

$C(CH_2OH)_4$ XII-6

$(HOCH_2)_3C—CH_3$ XII-7

$(HOCH_2)_3C—NHCOCH_3$ XII-8

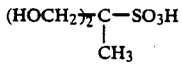

XII-9

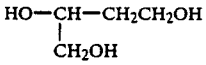

XII-10

Other examples of preferred alcohols are those represented by formula (XIII)

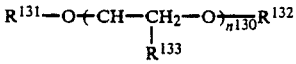

(XIII)

wherein $R^{131}$, $R^{132}$, and $R^{133}$ each represents a hydrogen atom or an alkyl group and $n^{130}$ represents a positive integer of 500 or less.

The alkyl group represented by $R^{131}$, and $R^{133}$ preferably contains 5 or less carbon atoms, and more preferably 2 or less carbon atoms. $R^{131}$, $R^{132}$, and $R^{133}$ are most preferably a hydrogen atom or a methyl group, and most preferably a hydrogen atom.

Also, $n^{130}$ is preferably an integer of from 3 to 100, and more preferably from 3 to 30.

Specific examples of the compounds shown by formula (XIII) are illustrated below.

$HO(CH_2CH_2O)_4OH$ XIII-1

$CH_3O(CH_2CH_2O)_3OH$ XIII-2

-continued $CH_3O(CH_2CH_2O)_2OCH_3$ XIII-3

$HO(CH(CH_3)CH_2O)_2OH$ XIII-4

$HOCH_2CH_2OCH_3$ XIII-5

$C_2H_5O(CH_2CH_2O)_2OH$ XIII-6

$HO(CH_2CH_2O)_nH$ XIII-7
Average molecular weight: about 300

$HO(CH_2CH_2O)_nH$ XIII-8
Average molecular weight: about 800

$HO(CH_2CH_2O)_nH$ XIII-9
Average molecular weight: about 3000

$HO(CH_2CH_2O)_nH$ XIII-10
Average molecular weight: about 8000

Examples of preferred oximes are those represented by formula (XIV)

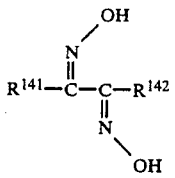

(XIV)

wherein $R^{141}$ and $R^{142}$ each represents a hydrogen atom, a substituted or unsubstituted alkyl group, or a substituted or unsubstituted aryl group, and $R^{141}$ and $R^{142}$ may be the same or different and they may combine with each other.

In formula (XIV), $R^{141}$ and $R^{142}$ are preferably a halogen atom, a hydroxy group, an alkoxy group, an amino group, a carboxyl group, a sulfo group, a phosphonic acid group, a nitro-substituted alkyl group, or an unsubstituted alkyl group.

The sum of the total carbon atoms of the compounds represented by formula (XIV) is preferably 30 or less, and more preferably 20 or less.

Specific examples of the compounds shown by formula (XIV) are illustrated below.

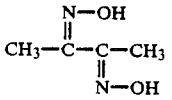

XIV-1

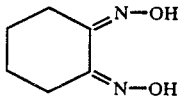

XIV-2

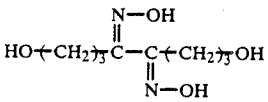

XIV-3

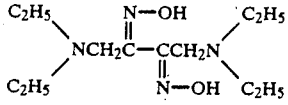

XIV-4

-continued

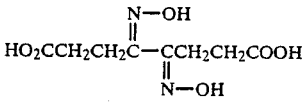

XIV-5

Examples of preferred polyamines are those represented by formula (XV)

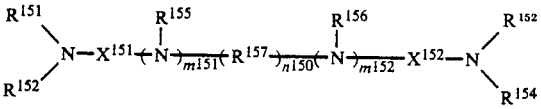

(XV)

wherein $X^{151}$ and $X^{152}$ represents —CO—or —SO—; $R^{151}$, $R^{152}$, $R^{153}$, $R^{154}$, $R^{155}$, and $R^{156}$ each represents a hydrogen atom or an unsubstituted or substituted alkyl group; and $R^{157}$ represents an unsubstituted or substituted alkylene group, an unsubstituted or substituted arylene group, or an unsubstituted or substituted aralkylene group and $m^{151}$, $m^{152}$, and $n^{150}$ represent 0 or 1. Preferably, the carbon atom number for $R^{151}$, $R^{152}$, $R^{153}$, $R^{154}$, $R^{155}$ and $R^{156}$ is 1 to 10, and $R^{151}$, $R^{152}$, $R^{153}$, $R^{154}$, $R^{155}$ and $R^{156}$ may have substituents such as a —OH group, a —COOH group, a $—SO_3H$ group etc.

Specific examples of the compound shown by formula (XV) are illustrated below.

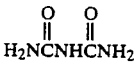

XV-1

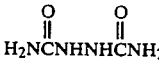

XV-2

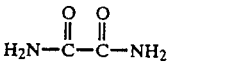

XV-3

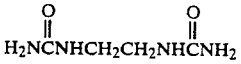

XV-4

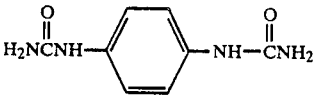

XV-5

$H_2NSO_2NHSO_2NH_2$ XV-6

Examples of preferred condensed cyclic amines are those represented by formula (XVI)

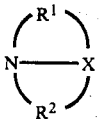

(XVI)

wherein X represents a trivalent atomic group such as

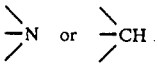

necessary for completing a condensed ring and $R^1$ and $R^2$ each represents an alkylene group, an arylene group, an alkenylene group or an aralkylene group, and $R^1$ and $R^2$ may be the same or different.

In the compounds represented by formula (XVI), the compounds represented by formulae (1 - a) and (1 - b) are particularly preferred:

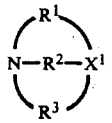

(1-a)

wherein $X^1$ represents

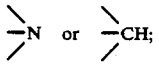

$R^1$ and $R^2$ are the same as defined above for formula (XVI); and $R^3$ represents the same group as $R^1$ and $R^2$ or

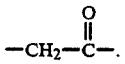

In formula (1 - a), $X^1$ is preferably

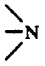

and the number of carbon atoms of each group represented by $R^1$, $R^2$, and $R^3$ is preferably 6 or less, more preferably 3 or less, and most preferably 2.

$R^1$, $R^2$, and $R^3$ are preferably an alkylene group or an arylene group, and most preferably an alkylene group.

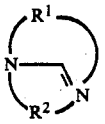

(1-b)

wherein $R^1$ and $R^2$ are the same as defined for formula (XVI).

In formula (1 - b), $R^1$ and $R^2$ preferably have 6 or less carbon atoms $R^1$ and $R^2$ are preferably an alkylene group or an arylene group, and most preferably an alkylene group.

Of the compounds represented by formulae (1 - a) and (1 - b), the compounds represented by formula (1 - a) are particularly preferred.

Specific examples of the compounds represented by formula (XVI) are illustrated below.

XVI-1

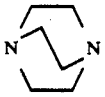

-continued

XVI-2

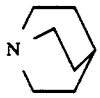

XVI-3

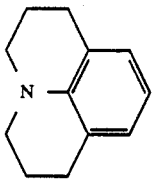

XVI-4

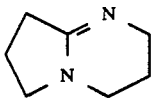

XVI-5

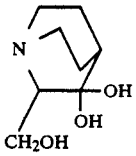

XVI-6

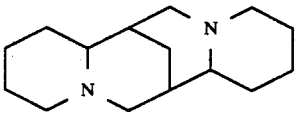

XVI-7

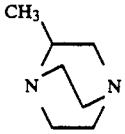

XVI-8

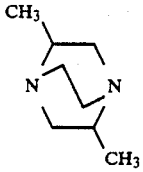

XVI-9

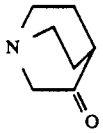

XVI-10

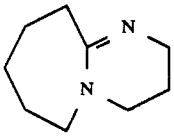

XVI-11

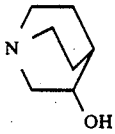

-continued

XVI-12

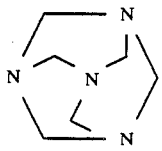

XVI-13

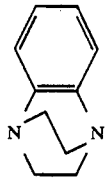

XVI-14

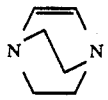

XVI-15

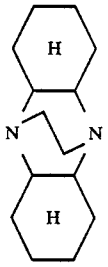

XVI-16

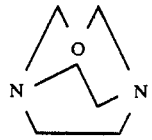

XVI-17

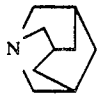

XVI-18

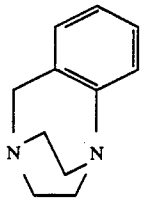

The compounds represented by formula (XVI) for use in this invention are commercially available.

The color developer for use in this invention will be explained.

The color developer for use in the invention contains an aromatic primary amine color developing agent which is well known. Preferred examples thereof are p-phenylenediamine derivatives and specific examples thereof are illustrated below although the invention is not limited to these compounds.

D - 1: N,N-Diethyl-p-phenylenediamine

D - 2: 4-[N-Ethyl-N-(β-hydroxyethyl)amino]aniline

D - 3: 2-Methyl-4-[N-ethyl-N-(8-hydroxyethyl-)amino]aniline

D - 4: 4-Amino-3-methyl-N-ethyl-N-(8-methanesulfoneamidoethyl)aniline.

Also, these p-phenylenediamine derivatives may be used in the form of salts thereof, such as sulfates, hydrochlorides, p-toluenesulfonated, etc.

The amount of the aromatic primary amine developing agent is preferably from about 0.1 g to about 20 g, and more preferably from about 0.5 g to about 10 g, per liter of the color developer.

The pH of the color developer for use in this invention is preferably from 9 to 12, and more preferably from 9 to 11.0. Also, the color developer may contain other conventional developer components.

For maintaining the aforesaid pH for the color developer, it is preferred to use various buffers. Examples of the buffers include sodium carbonate, potassium carbonate, sodium hydrogen carbonate, potassium hydrogen carbonate, trisodium phosphate, tripotassium phosphate, dipotassium hydrogen phosphate, disodium hydrogen phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), potassium 5-sulfo-2-hydroxybenzoate (potassium-5-sulfosalicylate), etc.

The amount of the buffer added to the color developer is preferably 0.1 mol/liter or more, and particularly preferably from 0.1 mol/liter to 0.4 mol/liter.

Furthermore, the color developer may contain a chelating agent for preventing precipitation of calcium and magnesium or improving the stability of the color developer.

Specific examples of the chelating agent are shown below, although the invention is not limited thereto.

Nitrilotriacetic Acid
Diethylenetriaminepentaacetic Acid
Ethylenediaminetetraacetic Acid
Triethylenetetraminehexaacetic Acid
N,N,N-Trimethylenephosphonic Acid
Ethylenediamine-N,N,N',N'-tetramethylenephosphonic Acid
1,3-Diamino-2-propanoltetraacetic Acid
Transcyclohexanediaminetetraacetic Acid
Nitrilotripropionic Acid
1,2-Diaminepropanetetraacetic Acid
Hydroxyethyliminodiacetic Acid
Glycol Ether Diaminetetraacetic Acid
Hydroxyethylenediaminetriacetic Acid
Ethylenediamine o-hydroxyphenylacetic Acid
2-Phosphonobutane-1,2,4-tricarboxylic Acid
1-Hydroxyethylidene-1,1-diphosphonic Acid
N,N'-Bis(2-hydroxybenzyl)ethylenediamine-N,N'diacetic Acid These chelating agents may be used singly or, if desired, as a mixture thereof.

The amount of the chelating agent(s) added may be one sufficient for blocking metal ions in the color developer, such as from about 0.1 g or 10 g per liter of the color developer.

The color developer may further contain a development accelerator.

Examples of the development accelerator include thioether series compounds as described in Japanese Patent Publications 16088/62, 5987/62, 7826/63, 12380/69, 9019/70, and U.S. Pat. No. 3,813,247, p-phenylenediamine series compounds as described in Japanese Patent Applications (OPI) No. 49829/77 and 15554/75, quaternary ammonium salts as described in Japanese Patent Publication No. 30074/69 and Japanese Patent Applications (OPI). No. 137726/75, 156826/81, and 43429/77, p-aminophenols as described in U.S. Pat. Nos. 2,610,122 and 4,119,462, amine series compounds as described in Japanese Patent Publication No. 11431/66 and U.S. Pat. Nos. 2,494,903, 3,128,182, 4,230,796, 3,253,919, 2,482,546, 2,596,926, and 3,582,346, polyalkylene oxides as described in U.S. Pat. Nos. 3,128,183 and 3,532,501 and Japanese Patent Publications No. 16088/62, 25201/67, 11431/66, and 23883/67, 1-phenyl-3-pyrazolidones, hydrazines, mesoion type compounds, ion type compounds, imidazoles, etc.

The color developer for use in this invention can, if desired, contain an antifoggant. Examples of the antifoggant include alkali metal halides such as sodium chloride, potassium bromide, potassium iodide, etc., and organic antifoggants. Typical examples of the organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolyl-benzimidazole, 2-thiazolylmethyl-benzimidazole, indazole, hydroxyazaindrizine, adenine, etc.

It is preferred that the color developer for use in this invention contain a brightening agent. Preferred examples of the brightening agent are 4,4'-diamino2,2'-disulfostilbene series compounds. The added amount thereof is generally from 0 to 5 g/liter, and preferably from 0.1 to 4 g/liter.

Also, if desired, the color developer may further contain various surface active agents such as alkylsulfonic acids, arylsulfonic acids, aliphatic carboxylic acids, aromatic carboxylic acids, etc.

The processing temperature for the color developer is generally from 20°to 50° C., and preferably from 30° to 40° C. The processing time is generally from 20 seconds to 5 minutes, and preferably from 30 seconds to 2 minutes.

The amount of replenisher for the color developer is preferably less but is usually from 20 ml to 600 ml, preferably from 50 ml to 300 ml, and more preferably from 100 ml to 200 ml, per $m^2$ of a light-sensitive material.

The bleaching solution or blixing solution for use in this invention can contain a rehalogenating agent such as a bromide (e.g., potassium bromide, sodium bromide and ammonium bromide), a chloride (e.g., potassium chloride, sodium chloride, and ammonium chloride), and an iodide (e.g., ammonium iodide).

Also, if desired, the color developer may further contain a corrosion preventing agent such as one or more inorganic acids, organic acids having pH buffer ability, the alkali metal or ammonium salts thereof (e.g., boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc.), ammonium nitrate, guanidine, etc.

The blixing solution or fixing solution for use in this invention contains a fixing agent and as the fixing agent, there are typically used thiosulfates such as sodium thiosulfate, ammonium thiosulfate, etc.; thiocyanates such as sodium thiocyanate, ammonium thicyanate, etc.; thioether compounds such as ethylene bisthioglycol, 3,6-dithia-1,8-octanediol, etc., and water-soluble silver halide dissolving agents such as thioureas.

These fixing agents can be used alone or as a mixture thereof. Also, a specific blixing solution composed of a combination of a fixing agent and a large amount of a halide such as potassium iodide as described in Japanese Patent Application (OPI) No. 155354/80 can be also used in this invention.

In this invention, the use of thiosulfates, in particular ammonium thiosulfate, is preferred.

The amount of the fixing agent is preferably from 0.3 to 2 mols, and more preferably from 0.5 to 1.0 mol, per mol of the blixing or fixing solution.

The pH range of the blixing solution or fixing solution for use in this invention is preferably from 3 to 10, and more preferably from 5 to 9. If the pH is lower than the aforesaid value, the desilvering property may be improved but the deterioration of the processing solution and the formation of leuco compounds from cyan dyes are accelerated. On the other hand, if the pH is higher than the aforesaid value, desilvering is delayed and stain is liable to occur.

For controlling the pH of the blixing solution or fixing solution, if desired, hydrochloric acid, sulfuric acid, nitric acid, acetic acid, hydrogen carbonates, ammonia, potassium hydroxide, sodium hydroxide, sodium carbonate, potassium carbonate, etc., may be used.

Also, the blixing solution may further contain optical whitening agents, defoaming agents, surface active agents, organic solvents such as polyvinyl pyrrolidone, methanol, etc.

The blixing solution or fixing solution for use in this invention contains a sulfite ion releasing compound such as a sulfite (e.g., sodium sulfite, potassium sulfite, and ammonium sulfite), a hydrogen sulfite (e.g., ammonium hydrogen sulfite, sodium hydrogen sulfite, and potassium hydrogen sulfite), a metahydrogen sulfite (e.g., potassium metahydrogen sulfite, sodium metahydrogen sulfite, and ammonium metahydrogen sulfite), as preservatives. The content of the sulfite ion releasing compound is preferably from at,out 0.02 to 0.50 mol/liter, and more preferably from about 0.04 to to 0.40 mol/liter as sulfite ion.

As the preservatives, the sulfite as described above is generally used in the blixing or fixing solution, but ascorbic acid, a carbonyl hydrogen sulfite addition product, or a carbonyl compound may be used as the preservatives.

Furthermore, if desired, a buffering agent,a brightening agent, a chelating agent, an antifungant, etc., may be, if desired, added to the blixing solution or fixing solution.

In this invention, after applying the desilvering treatment such as the fixing or blixing, the silver halide color photographic material thus processed is generally subjected to a washing step and/or a stabilization step.

The amount of washing water for the washing step is selected in a wide range depending on the characteristics (e.g., materials used therein, such as couplers, etc.) and uses of the color photographic materials being processed, the temperature of the washing water, the number of tanks (stage number), the replenishing system such as countercurrent system, cocurrent system, etc., and other various conditions. The relation of the number of washing tanks and the amount of water in the multistage countercurrent can be determined by the method described in *Journal of the Society of Motion Picture and Television Engineers*, Vol. 64, pages 248–253 (May, 1955).

According to the multistage countercurrent system described in the aforesaid literature, the amount of washing water can be greatly reduced but there occurs a problem that by the increase of the retension time of the watering in the tanks, bacteria breed and floats thus formed adhere to photographic materials.

In the process of this invention, for overcoming these problems, a method of reducing calcium and magnesium described in Japanese Patent Application(OPI) No. 288838/87 (corresponding to U.S. Patent Application Ser. No. 57,254 can be very effectively used. Also, chlorine series disinfectants such as isothiazolone compounds as described in Japanese Patent Application (OPI) No. 8542/82, thiabendazoles, chlorinated sodium isocyanurate, etc., benzotriazole, and other disinfectants as described in Hiroshi Horiguchi, *Bokin Bobai No Kagaku (Antibacterial and Antifungal Chemistry), Biseibutsu no Mekkin, Sakkin, Bobai Gijutsu (Sterilizing and Antifungal Techniques of Microorganisms)*, edited by the Society of Sanitary Technology, and "*Bokin Bobaizai Jiten (Handbook of Antibacterial and Antifungal Agents)*, edited by the antibacterial and Antifungal Society of Japan can be used.

The pH of the washing water in the processing of this invention is from 4 to 9, and preferably from 5 to 8. The temperature of the washing water and the washing time can be desirably selected depending on the characteristics and uses of the color photographic materials being processed but they are selected in the ranges of, generally, from, 15° C. to 45° C. and from 20 seconds to 10 minutes, and preferably from 25° C. to 40° C. and from 30 seconds to 5 minutes.

Furthermore, in this invention, the color photographic materials can be directly processed by a stabilization solution without using the aforesaid washing step. In such a stabilization process, various processes as described in Japanese Patent Applications (OPI) No. 543/82, 14834/83, 184343/84, 220235/85, 238832/85, 39784/85, 239749/85,4054/86, and 118749/96 can be employed. In particular, stabilizing baths containing 1-hydroxyethylidene-1,1-diphosphonic acid, 5-chloro-2-methyl-4-isothiazolin-3-one, a bismuth compound, an ammonium compound, etc., are preferably used.

Also, when in succession to the aforesaid washing processing, a stabilization process is applied, for an example, a stabilizaiton bath containing formalin and a surface active agent, which is used as a final bath for color photographic materials for photography, can be used.

The silver halide contained in the photographic emulsion layers of the color photographic light-sensitive material which is processed by the process of this invention may have different phases between the inside and the surface layer thereof, may have a multiphase structure having a junction structure, or may have a uniform phase throughout the whole grain. Also, the silver halide may be composed of a mixture of these various structures.

The silver halide grains in this invention may have a regular crystal form such as cubic, octahedral, tetradecahedral, etc., an irregular crystal form such as spherical, tabular, etc., a crystal form having a crystal defect such as twinned crystal, etc., or may be a composite form thereof.

The grain size of the silver halide may be about 0.2 micron or less or may be as large as about 10 microns in the diameter of the projected area thereof. Also, the silver halide emulsion in this invention may be a polydisperse emulsion or a monodisperse emulsion.

The silver halide photographic emulsions in this invention can be prepared by using the methods described in *Research Disclosure*, RD No. 17643, pages 22–23 (1978, December), "Emulsion Preparation and Types".

In this invention, monodisperse silver halide emulsions as described in U.S. Pat. Nos. 3,574,628 and 3,655,394 and British Patent No. 1,413,748 are preferred.

Also, tabular grain silver halide emulsion having an aspect ratio of at least 5 are preferred. The tabular grain silver halide emulsions can be easily prepared by the methods described in Gutoff, *Photographic Science and Engineering*, Vol. 14, pages 248–257(1970), U.S. Pat. Nos. 4,434,226, 4,414,310, 4,433,048 and 4,439,520, and British Patent No. 2,112,157, etc.

The crystal structure may have a different halogen phase between the inside and the surface portion, or a layer structure, may have a junction structure of silver halides having different composition joined by epitaxial junction, or may have a structure form by joining with a compound other than silver halide, such as silver rhodanate, lead oxide, etc. Furthermore, the silver halide structure may be composed of a mixture of silver halide grains having various crystal forms.

The silver halide emulsions for use in this invention are usually physically ripened, chemically ripened, and optically sensitized. Additives for use in such treatments are described in *Research Disclosures* RD No. 17643 and 18716 and relevant portions thereof are shown below.

Also, other photographic additives which can be used in this invention are also described in the aforesaid literature and they are also shown below.

| Kind of Additives | RD 17643 | RD 18716 |
|---|---|---|
| 1. Chemical Sensitizer | p. 23 | p. 648, right column |
| 2. Sensitivity Increasing Agent | — | " |
| 3. Spectral Sensitizer and Supercolorsensitizer | pp. 23–24 | p. 648, right column to p. 649, right column |
| 4. Brightening Agent | p. 24 | — |
| 5. Antifoggant and Stabilizer | pp. 24–25 | p. 649, right column |
| 6. Light Absorbent, Filter Dye and Ultraviolet Absorbent | pp. 25–26 | p. 649, right column to p. 650, left column |
| 7. Stain Preventing Agent | p. 25, right column | p. 650, left to right columns |
| 8. Dye Image Stabilizer | p. 25 | — |
| 9. Hardening Agent | p. 26 | p. 651, left column |
| 10. Binder | p. 26 | " |
| 11. Plasticizer and Lubricant | p. 27 | p. 650, right column |
| 12. Coating Aid and Surfactant | pp. 26–27 | " |
| 13. Antistatic Agent | p. 27 | " |

For the color photographic materials which are processed by the process of this invention, various color forming couplers can be used and practical examples are described, for example, in the patents cited in *Research Disclosure* (RD) No. 17643, VII-C to VII-G.

As yellow couplers, the couplers described in U.S. Pat. Nos. 3,933,501, 4,022,620, 4,326,024, and 4,401,752, Japanese Patent Publication 10739/83 and British Patents No. 1,425,020 and 1,466,760 are preferred.

As magenta couplers, 5-pyrazolone or pyrazoloazole series compounds are preferably used and the couplers described in U.S. Pat. No. 4,310,619, 4,351,897, 3,061,432, 3,725,067, 4,500,630, and 4,540,654, European Patent No. 73,636, Japanese Patent Applications (OPI) 33552/85 and 43659/85, *Research Disclosure* RD No. 24220 (June, 1984) and ibid. 24230 (July, 1984) are particularly preferred.

As cyan couplers, there are phenolic cyan couplers and naphtholic cyan couplers and the compounds described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, 3,446,622, 4,333,999, 4,451,559, and 4,427,767, West German Patent Application (OLS) 3,329,729, European Patents Nos. 121,365A and 161,626A are preferred.

For the color photographic materials which are processed by the process of this invention, colored couplers can be used for correcting unnecessary absorption of color forming dyes and, as such colored couplers, the compounds described in *Research Disclosure* RD No. 17643, Paragraph VII-G, U.S. Pat. Nos. 4,163,670, 4,004929, and 4,138,258, Japanese Patent Publication No. 39413/82, and British Patent No. 1,146,368 can preferably be used.

Color forming dyes having proper diffusibility can be used in this invention and, as such couplers, the compounds described in U.S. Pat. No. 4,366,237, British Patent No. 2,125,570,European Patent No. 96,570, and West German Patent Application (OLS) No. 3,234,533 are preferably used.

In this invention, polymerized color forming couplers can be also used and typical examples of these couplers are described in U.S. Pat. Nos. 3,451,820, 4,080,211, and 4,367,282, and British Patent No. 2,102,173.

Couplers releasing a photographically useful group upon a coupling reaction can be preferably used in this invention. DIR couplers releasing development inhibitors as are described in the patents cited in *Research Disclosure* RD. No. 17643, VII-F, Japanese Patent Applications (OPI) Nos. 151944/82, 154234/82 and 184248/85, and U.S. Pat. No. 4,248,962 can be preferably used. Couplers imagewise releasing nucleating agents or development accelerators at development can be used in this invention and as such couplers, the compounds described in British Patents Nos. 2,097,140 and 2,131,188 and Japanese Patent Applications (OPI) No. 157638/84 and 170840/84 are preferred.

As other couplers which can be used for the color photographic materials in this invention, there are competing couplers as described in U.S. Pat. No. 4,130,427, etc., poly-equivalent couplers as described in U.S. Pat. Nos. 4,283,427, 4,338,393, and 4,310,618, DIR redox compound releasing couplers as described in Japanese Patent Application (OPI) No. 185950/85, etc., and couplers releasing dyes which are recolored after release as described in European Patent No. 173,302A, etc.

The aforesaid various couplers which can be used for the color photographic materials in this invention can be incorporated in the color photographic materials by various dispersion methods which is well-known.

One of these method is an oil drop-in-water dispersion method. Examples of high-boiling organic solvents which are used for such a dispersion method are described in U.S. Pat. No. 2,322,027, etc.

A latex dispersion method can be also used for incorporating the couplers in the color photographic materials, and the steps and effects of the dispersion method and practical examples of latexes for impregnation are described in U.S. Pat. No. 4,199,363 and West German Patent Applications (OLS) Nos. 2,541,274 and 2,541,230.

Suitable supports for the color photographic materials which are processed by the process of this invention are described, for example, *Research disclosure* 17643, page 28 and ibid. 18716, page 647, right column to page 648, left column.

The following examples serve to illustrate the present invention without limiting, however, the scope of the invention.

EXAMPLE 1

Sample 101 having layers of the compositions shown below on a triacetyl cellulose film support having a subbing layer was prepared.

Composition of photographic Layers

The coated amounts are by g/m$^2$ unit as silver for silver halide emulsion and colloidal silver, by g/m$^2$ unit for coupler, additive, and gelatin, and by mol(s) per mol of silver halide in the same layer for sensitizing dye.

In addition, the abbreviations for the following layers are as follows: UV: Ultraviolet Absorbent; Solv: High Boiling Organic Solvent; ExF: Dye; ExS: Sensitizing Dye; ExC: Cyan Coupler; ExM: Magenta Coupler; ExY: Yellow Coupler; H: Hardener; and Cpd: Compound or Additive.

| | |
|---|---|
| First Layer (Antihalation Layer): | |
| Black ColloidalSilver | 0.2 |
| Gelatin | 1.3 |
| ExM-9 | 0.06 |
| UV-1 | 0.03 |
| UV-2 | 0.06 |
| UV-3 | 0.06 |
| Solv-1 | 0.15 |
| Solv-2 | 0.15 |
| Solv-3 | 0.05 |
| Second Layer (Interlayer): | |
| Gelatin | 1.0 |
| UV-1 | 0.03 |
| ExC-4 | 0.02 |
| ExF-1 | 0.004 |
| Solv-1 | 0.1 |
| Solv-2 | 0.1 |
| Third Layer (Slow-Speed Red-Sensitive Emulsion Layer): | |
| Silver Iodobromide Emulsion (AgI: 4 mol %, uniform AgI type, sphere corresponding diameter: 0.5 μm, variation coeff. of sphere corresponding diameter: 20%, tabular grain, aspect ratio (diameter/thickness): 3.0) | 1.2 |
| Silver Iodobromide Emulsion (AgI: 3 mol %, uniform AgI type, sphere corresponding diameter: 0.3 μm, variation coeff. of sphere corresponding diameter: 15%, tabular grain, aspect ratio: 1.0) | 0.6 |
| Gelatin | 1.0 |
| ExS-1 | $4 \times 10^{-4}$ |
| ExS-2 | $5 \times 10^{-5}$ |
| ExC-1 | 0.05 |
| ExC-2 | 0.50 |
| ExC-3 | 0.03 |
| ExC-4 | 0.12 |
| ExC-5 | 0.01 |
| Fourth Layer (High-Speed Red-Sensitive Emulsion Layer): | |
| Silver Iodobromide Emulsion (AgI: 6 mol %, inside high AgI type of core-shell ratio of 1/1, sphere corresponding diameter: 0.7 μm, variation coeff. of sphere corresponding diameter: 15%, tabular grain, aspect ratio: 5.0) | 0.7 |
| Gelatin | 1.0 |

-continued

| | |
|---|---|
| ExS-1 | $3 \times 10^{-4}$ |
| ExS-2 | $2.3 \times 10^{-5}$ |
| ExC-6 | 0.11 |
| ExC-7 | 0.05 |
| ExC-4 | 0.05 |
| Solv-1 | 0.05 |
| Solv-3 | 0.05 |
| Fifth Layer (Interlayer): | |
| Gelatin | 0.5 |
| Cpd-1 | 0.1 |
| Solv-1 | 0.05 |
| Sixth Layer (Slow-Speed Green-Sensitive Emulsion Layer): | |
| Silver Iodobromide Emulsion (AgI: 4 mol %, surface high AgI type of core-shell ratio of 1/1, sphere corresponding diameter: 0.5 μm, variation coeff. of sphere corresponding diameter: 15%, tabular grain, aspect ratio: 4.0) | 0.35 |
| Silver Iodobromide Emulsion (AgI: 3 mol %, uniform AgI type, sphere corresponding diameter: 0.3 μm, variation coeff. of sphere corresponding diameter: 25%, tabular grain, aspect ratio: 1.0) | 1.20 |
| Gelatin | 1.0 |
| ExS-3 | $5 \times 10^{-4}$ |
| ExS-4 | $3 \times 10^{-4}$ |
| ExS-5 | $1 \times 10^{-4}$ |
| ExM-8 | 0.4 |
| ExM-9 | 0.07 |
| ExM-10 | 0.02 |
| ExY-11 | 0.03 |
| Solv-1 | 0.3 |
| Solv-4 | 0.05 |
| Seventh Layer (High-Speed Green-Sensitive Emulsion Layer): | |
| Silver Iodobromide Emulsion (AgI: 4 mol %, inside high AgI type of core-shell ratio of 1/3, sphere corresponding diameter: 0.7 μm, variation coeff. of sphere corresponding diameter 20%, tabular grain, aspect ratio: 5.0) | 0.8 |
| ExS-3 | $5 \times 10^{-4}$ |
| ExS-4 | $3 \times 10^{-4}$ |
| ExS-5 | $1 \times 10^{-4}$ |
| ExM-8 | 0.01 |
| ExM-9 | 0.02 |
| ExY-11 | 0.03 |
| ExC-2 | 0.03 |
| ExM-14 | 0.01 |
| Solv-1 | 0.2 |
| Solv-4 | 0.01 |
| Eighth Layer (Interlayer): | |
| Gelatin | 0.5 |
| Cpd-1 | 0.05 |
| Solv-1 | 0.02 |
| Ninth Layer (Doner Layer having multi-layer Effect onto Red-Sensitive Layers): | |
| Silver Iodobromide Emulsion (AgI: 2 mol %, inside high AgI type of core-shell ratio of 2/1, sphere corresponding diameter: 1.0 μm, variation coeff. of sphere corresponding diameter: 15%, tubular grain, aspect ratio: 6.0) | 0.35 |
| Silver Iodobromide Emulsion (AgI: 2 mol %, inside high AgI type of core-shell ratio of 1/1, sphere corresponding diameter: 0.4 μm variation coeff. of sphere corresponding diameter: 20%, tabular grain, aspect ratio: 6.0) | 0.20 |

-continued

| | |
|---|---|
| Galatin | 0.5 |
| ExS-3 | $8 \times 10^{-4}$ |
| ExY-13 | 0.11 |
| ExM-12 | 0.03 |
| ExM-14 | 0.10 |
| Solv-1 | 0.20 |
| Tenth Layer (Yellow Filter Layer): | |
| Yellow Colloid Silver | 0.05 |
| Gelatin | 0.5 |
| Cpd-2 | 0.13 |
| Cpd-1 | 0.10 |
| Eleventh Layer (Slow-Speed Green-Sensitive Emulsion Layer): | |
| Silver Iodobromide Emulsion (AgI: 4.5 mol %, uniform AgI type, sphere corresponding diameter: 0.7 μm, variation coeff. of sphere corresponding diameter: 15%, tabular grain, aspect ratio: 7.0) | 0.3 |
| Silver Iodobromide Emulsion (AgI: 3 mol %, uniform AgI type, sphere corresponding diameter: 0.3 μm, variation coeff. of sphere corresponding diameter: 25%, tabular grain, aspect ratio: 7.0) | 0.15 |
| Gelatin | 1.6 |
| ExS-6 | $2 \times 10^{-4}$ |
| ExC-16 | 0.05 |
| ExC-2 | 0.10 |
| ExC-3 | 0.02 |
| ExY-13 | 0.07 |
| ExY-15 | 0.5 |
| ExC-17 | 1.0 |
| Solv-1 | 0.20 |
| Twelfth Layer (High-Speed Blue-Sensitive Emulsion Layer): | |
| Silver Iodobromide Emulsion (AgI: 10 mol %, inside high AgI type, sphere corresponding diameter: 1.0 μm, variation coeff. of sphere corresponding diameter, multiple twin crystal tabular grain, aspect ratio: 2.0) | 0.5 |
| Gelatin | 0.5 |
| ExS-6 | $1 \times 10^{-4}$ |
| ExY-15 | 0.20 |
| ExY-13 | 0.01 |
| Solv-1 | 0.10 |
| Thirteenth Layer (1st Protective Layer): | |
| Gelatin | 0.8 |
| UV-4 | 0.1 |
| UV-5 | 0.15 |
| Solv-1 | 0.01 |
| Solv-2 | 0.01 |
| Fourteenth Layer (2nd Protective Layer): | |
| Fine Grein Silver Bromide Emulsion (AgI: 2 mol %, uniform AgI type, sphere corresponding diameter: 0.07 μm) | 0.5 |
| Gelatin | 0.45 |
| Polymethyl Methacrylate Particles (diameter: 1.5 μm) | 0.2 |
| H-1 | 0.4 |
| Cpd-3 | 0.5 |
| Cpd-4 | 0.5 |

Each layer further contained 0.04 g/m$^2$ of a stabilizer, Cpd - 3 for the emulsion and 0.02 g/m$^2$ of a surface active agent, Cpd - 4 as coating aid. Furthermore, each layer contained 0.5 g/m$^2$ of a compound Cpd - 5 and 0.5 g/m$^2$ of a compound, Cpd - 6.

The compounds used for the aforesaid layers were as follows.

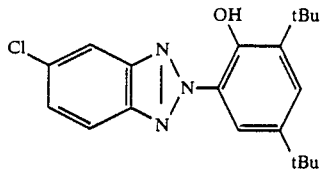

UV-1

-continued
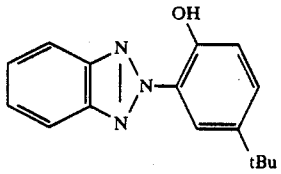
UV-2
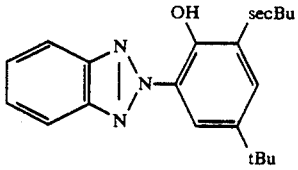
UV-3
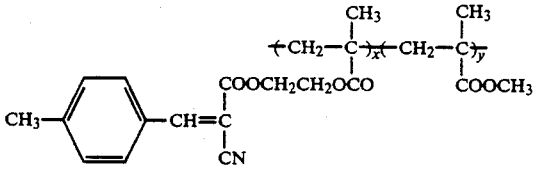
(x/y = 7/3 (weight ratio))
UV-4
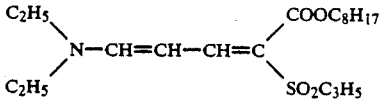
UV-5
Tricresyl Phosphate — Solv-1
Dibutyl Phthalate — Solv-2
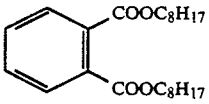
Solv-3
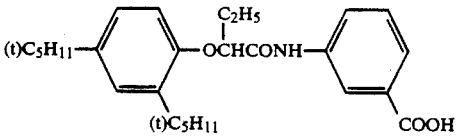
Solv-4
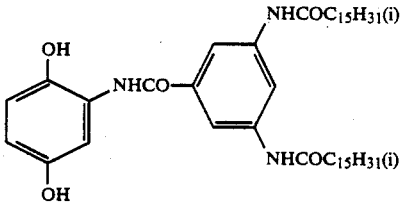
Cpd-1
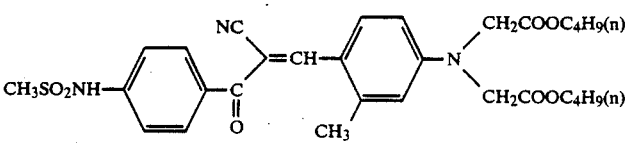
Cpd-2
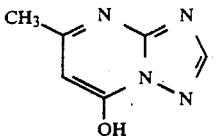
Cpd-3

-continued
Cpd-4
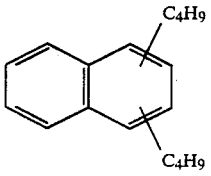
Cpd-5
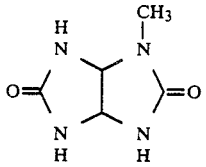
Cpd-6
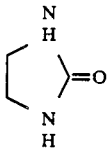
ExC-1
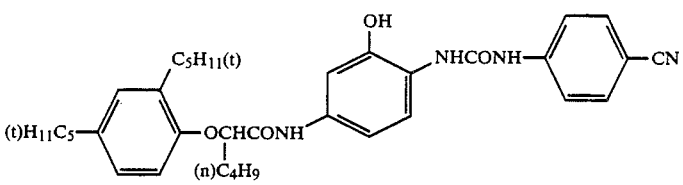
ExC-2
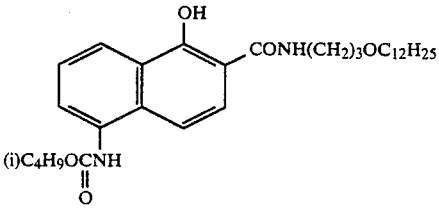
ExC-3
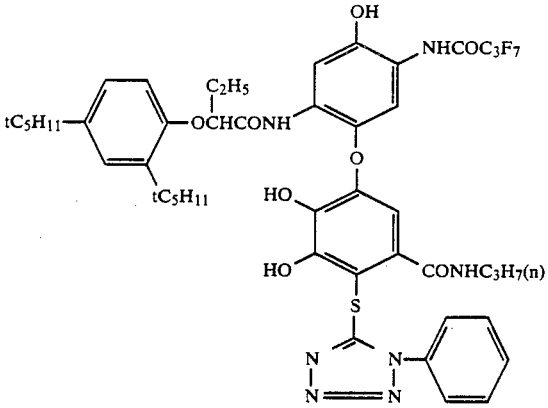
ExC-4
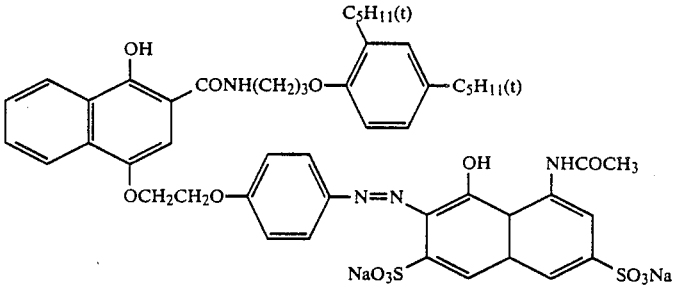

-continued
ExC-5
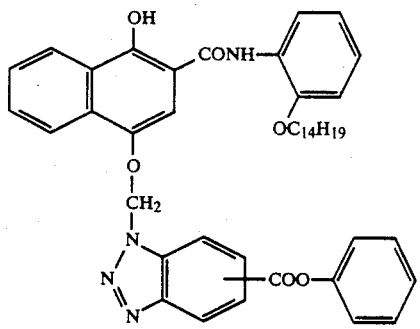
ExC-6
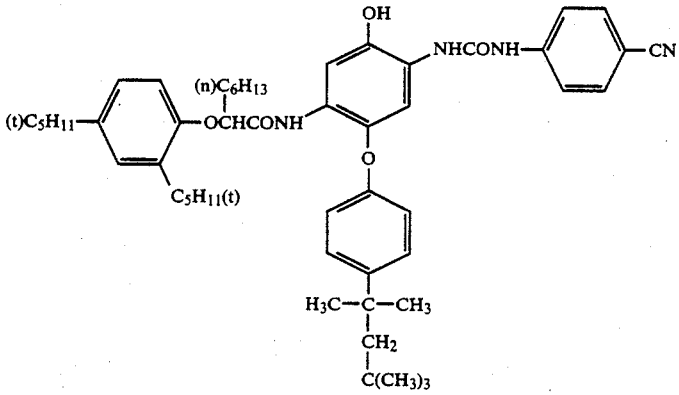
ExC-7
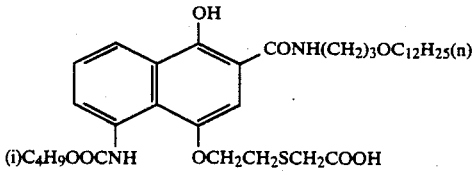
ExM-8
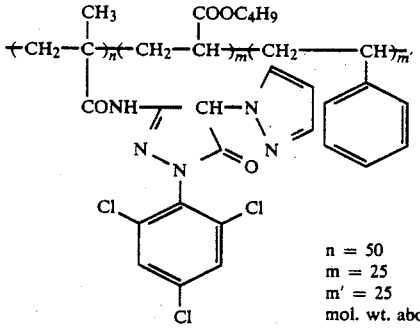
n = 50
m = 25
m' = 25
mol. wt. about 20,000
ExM-9
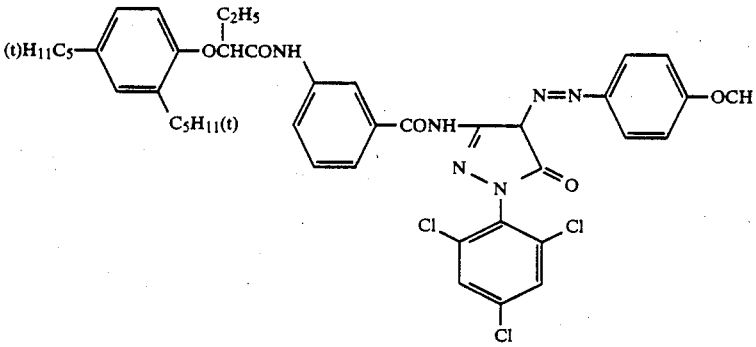

-continued
ExM-10
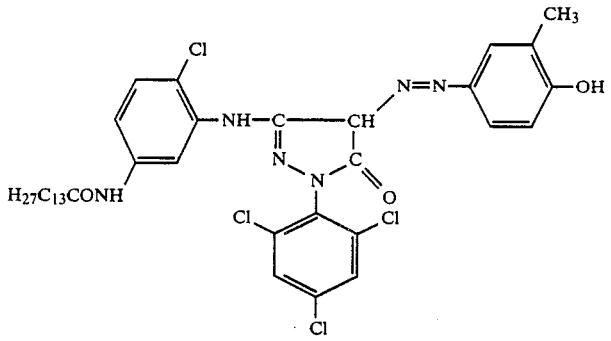
ExY-11
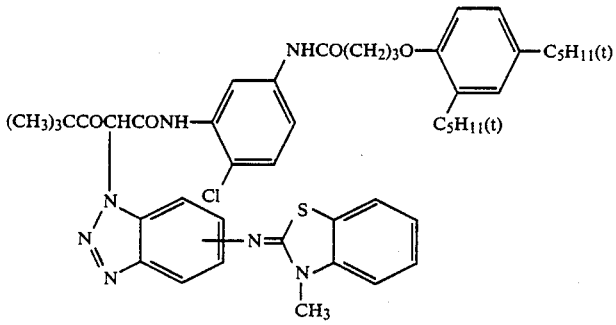
ExM-12
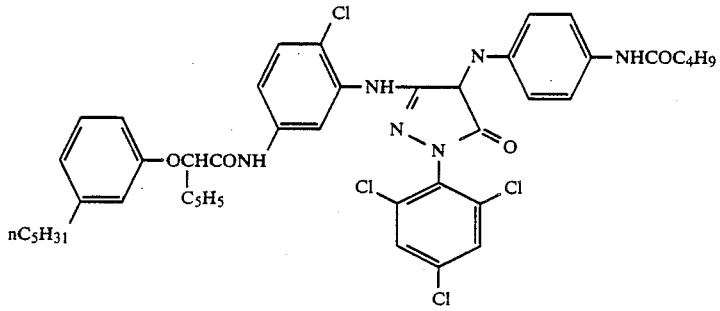
ExY-13
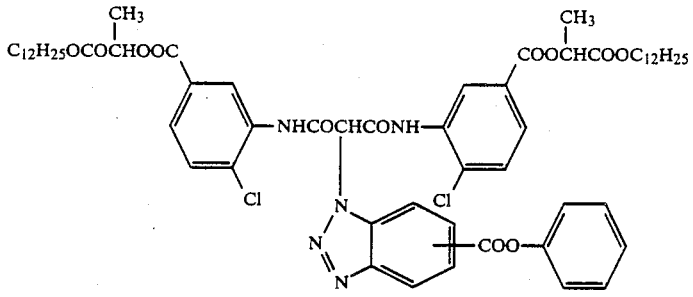
ExM-14
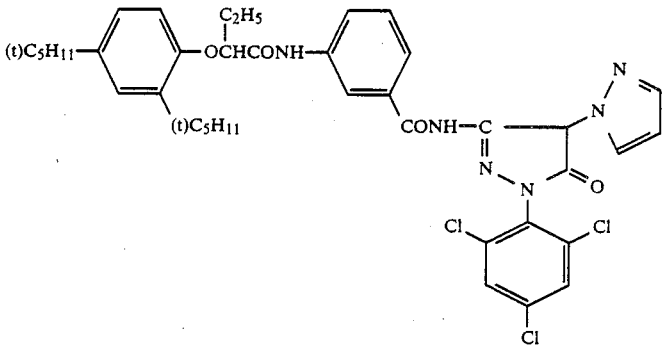

-continued
ExY-15
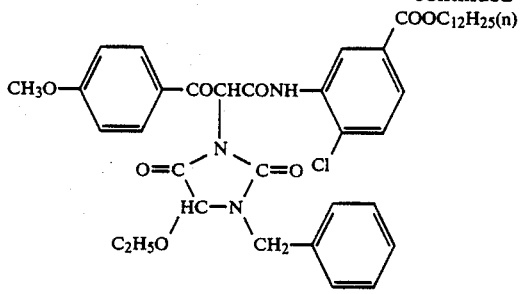
ExY-16
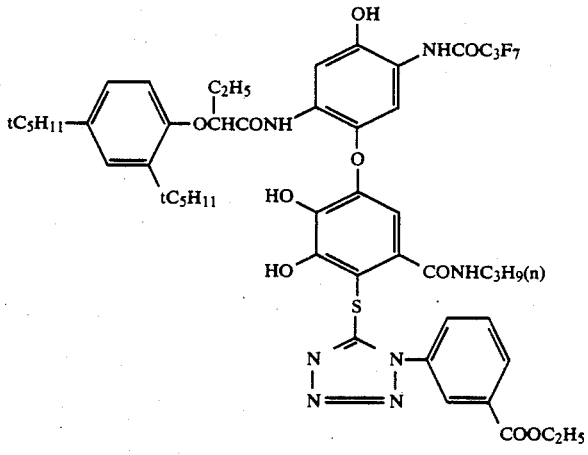
ExY-17
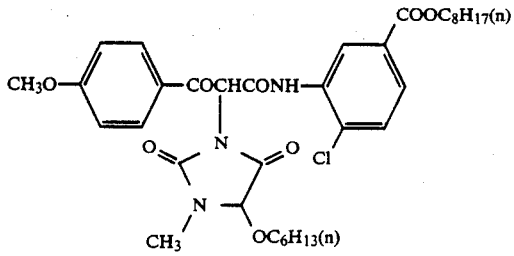
ExS-1
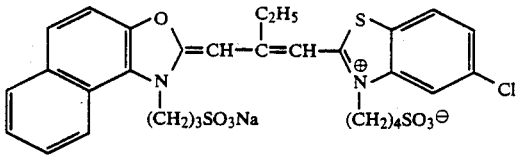
ExS-2
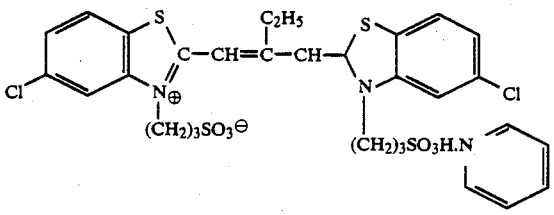
ExS-3
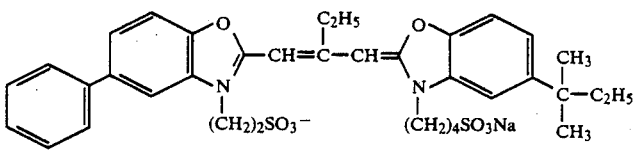
(molecular weight: 717)

-continued

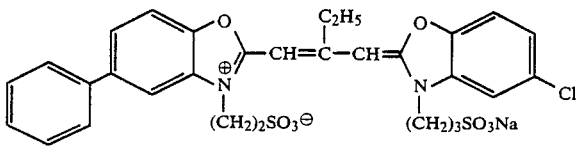

ExS-4

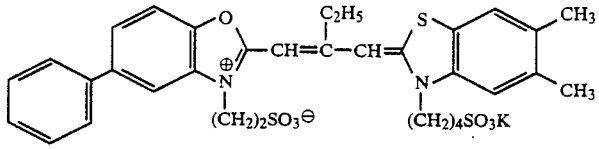

ExS-5

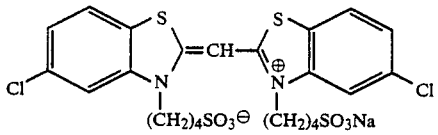

ExS-6

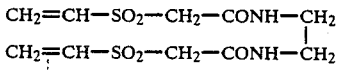

H-1

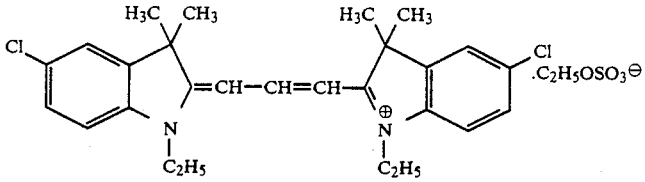

ExF-1

Sample 101 thus prepared was cut into a web film of 35 mm in width and, after imagewise exposure, was subjected to continuous processing using an automatic processor for negative color photographic film by the following processing steps. The replenisher amount of the color developer became three times the volume of the developer tank. In this case, however, the bleaching agent for the bleaching bath was changed as shown in Table 1 below.

| Step | Temp. | Time | Replenisher amount ($ml/m^2$-light-sensitive material) |
|---|---|---|---|
| Color development | 38° C. | 3 min. and 15 sec. | 40 |
| Bleaching | " | 2 min. | 20 |
| Fixing | " | 4 min. | 30 |
| Rinse (1)* | 35° C. | 45 sec. | — |
| Rinse (2)* | 35° C. | 45 sec. | 30 |
| Stabilization | " | 30 sec. | 30 |
| Drying | 50° C. | 1 min. | — |

*The rinse a was performed by a countercurrent system of flow from Rinse tank (2) to Rinse tank (1).

The formulas of the processing solutions were as follows.

| | Tank | Replenisher |
|---|---|---|
| Color Developer | | |
| Diethylenetriaminepentaacetic Acid | 3.0 g | 3.0 g |
| Sodium Sulfite (shown in Table 1) | | |
| Potassium Carbonate | 30.0 g | 32.0 g |
| Potassium Bromide | 1.4 g | 0.7 g |
| Potassium Iodide | 1.3 mg | — |
| Compound X (shown in Table 1) | | |
| 4-(N-Ethyl-N-β-hydroxyethyl-amino)-2-methylaniline Sulfate | 4.5 g | 5.0 g |
| Water to make | 1.0 liter | 1.0 liter |
| pH | 10.00 | 10.20 |
| Bleaching Solution | | |
| Bleaching Agent (shown in Table 1 | 0.25 mol | 0.275 mol |
| Cherating Agent (shown in Table 1) | 0.25 mol | 0.275 mol |
| Ammonium Bromide | 150.0 g | 175.0 g |
| Ammonium Nitrate | 8.0 g | 10.0 g |
| Aqueous Ammonia (28 wt %) | 7.0 ml | 4.0 ml |
| Water to make | 1.0 liter | 1.0 liter |
| pH | 6.0 | 5.7 |
| Fixing Solution | | |
| Ethylenediaminetetraacetic Acid · Di-sodium Salt | 2.0 g | 4.4 g |
| Sodium Sulfite | 16.0 g | 7.0 g |
| Aqueous Solution of Ammonium Thiosulfate (70 wt %) | 200.0 g | 240 ml |
| Sodium Hydrogen Sulfite | 4.0 g | 12.2 g |
| Aqueous Ammonia | — | 10.0 ml |
| Water to make | 1.0 liter | 1.0 liter |
| pH | 7.3 | 7.5 |
| Rinsing Solution | | |
| Ethylenediaminetetraacetic Acid · Di-Sodium Salt | 1.0 g | 1.0 g |
| Water to make | 1 liter | 1 liter |
| pH | 7.0 | 7.0 |
| Stabilizing Solution | | |
| Formalin (37 wt %) | 1.0 ml | 1.5 ml |
| Fuji Dry Well* | 5 ml | 5 ml |
| Water to make | 1 liter | 1 liter |

*Photo wetting agent (trade name, made by Fuji Photo Film Co., Ltd.)

After adjusting a light-exposure for a silver halide color photographic material (sample 101) as described above so that the amount of a developed silver obtained in the color photographic material samples for each running solution each becomes same, the color photographic material samples was processed according to the above processing steps, and the residual silver amount was measured by the fluorescent X ray analysis method. The results thus-obtained are shown in Table 1.

TABLE 1

| Test No. | Bleaching Agent | Chelating Agent | Compound X (0.05 mol/l) | Sodium sulfite Tank Solution/ Replenisher (g/l/g/l) | Residual Silver Amount ($\mu g/cm^2$) | |
|---|---|---|---|---|---|---|
| 1-1 | Nitrilotriacetic Acid Iron (III) $NH_4$ | Nitrilotriacetic Acid | I-9 | 4.0/4.4 | 59 | comparison |
| 1-2 | Ethylenediamine-N,N'-diacetic Acid Iron (III) $NH_4$ | Ethylenediamine-N,N'-diacetic Acid | " | 4.0/4.4 | 43 | " |
| 1-3 | EDTA Iron (III) $NH_4$ | EDTA | " | 4.0/4.4 | 38 | " |
| 1-4 | *2(A-1) Iron (III) $NH_4$ | A-1*2 | " | 4.0/4.4 | 20 | " |
| 1-5 | *2(A-2) Iron (III) $NH_4$ | A-2*2 | " | 4.0/4.4 | 18 | " |
| 1-6 | *2(A-3) Iron (III) $NH_4$ | A-3*2 | " | 4.0/4.4 | 19 | " |
| 1-7 | Nitrilotriacetic Acid Iron (III) $NH_4$ | Nitrilotriacetic Acid | " | 0 | 56 | " |
| 1-8 | Ethylenediamine-N,N'-diacetic Acid Iron (III) $NH_4$ | Ethylenediamine-N,N'-diacetic Acid | " | 0 | 41 | " |
| 1-9 | EDTA Iron (III) $NH_4$ | EDT | " | 0 | 36 | " |
| 1-10 | *2(A-1) Iron $NH_4$ | A-1*2 | I-9 | 0 | 1.3 | Present invention |
| 1-11 | *2(A-2) Iron $NH_4$ | A-2*2 | " | 0 | 1.8 | Present invention |
| 1-12 | *2(A-3) Iron $NH_4$ | A-3*2 | " | 0 | 1.9 | Present invention |
| 1-13 | *2(A-4) Iron $NH_4$ | A-4*2 | " | 0 | 1.1 | Present invention |
| 1-14 | " | " | I-1 | 0 | 1.2 | Present invention |
| 1-15 | " | " | II-1 | 0 | 1.7 | Present invention |
| 1-16 | *2(A-4) Iron $NH_4$ | " | III-11 | 0 | 1.9 | Present invention |
| 1-17 | " | " | IV-3 | 0 | 1.7 | Present invention |
| 1-18 | " | " | V-1 | 0 | 1.9 | Present invention |
| 1-19 | " | " | VI-5 | 0 | 2.0 | Present invention |
| 1-20*1 | *2(A-4) Iron (III) $NH_4$ | A-4*2 | VII-1*1 | 0 | 2.1 | Present invention |
| 1-21 | " | " | VIII-1 | 0 | 1.8 | Present invention |
| 1-22 | " | " | IX-1 | 0 | 2.0 | Present invention |
| 1-23 | " | " | X-1 | 0 | 1.9 | Present invention |
| 1-24 | " | " | XI-1 | 0 | 1.9 | Present invention |
| 1-25 | " | " | XII-1 | 0 | 2.2 | Present invention |
| 1-26 | " | " | XIII-1 | 0 | 2.0 | Present invention |
| 1-27 | " | " | XIV-1 | 0 | 2.1 | Present invention |
| 1-28 | " | " | XV-1 | 0 | 2.0 | Present invention |
| 1-29 | " | " | XV-1 | 0 | 1.8 | Present invention |

*1Test Nos. 1-20 to 1-29 contained further Compound I-1 (i.e., hydroxyamines of this invention) as Compound X of Table 1 in an amount of 0.05 mol/l.
*2A-1: Diethylenetriaminepentaacetic Acid
A-2: Cyclohesanediaminetetraacetic Acid
A-3: Glycol Ether Diaminetetraacetic Acid
A-4: 1,3-Diaminopropanetetraacetic Acid As is clear from the results shown in Table 1 above, according to the process of this invention the residual silver amount is greatly reduced in the case of using the bleaching agent of this invention (Test Nos. 1-10 to 1-29) as compared to the comparison tests using a bleaching agent having a molecular weight of less than 300 (Test Nos. 1-1, 1-2, and 1-3) (Test Nos. 1-7, 1-8, and 1-9) or the comparison tests where sodium sulfite was present in the color developer (Test Nos. 1-1 to 1-6).

EXAMPLE 2

A multilayer color photographic paper having the following layer structure on a paper support (both surfaces of which were coated with polyethylene) was prepared. The coating composition for each layer was prepared as follows.

Preparation of Coating Composition for Layer 1

In 27.2 ml of ethyl acetate and 7.7 ml of a solvent (Solv - 1) shown below were dissolved 19.1 g of yellow coupler (ExY) and 4.4 g of color image stabilizer (Cpd - 1) shown below and the solution thus formed was dispersed by emulsificaiton in 185 ml of an 10% aqueous gelatine solution containing 8 ml of an 10% aqueous solution of sodium dodecylbenzenesulfonate. On the other hand, a silver chlorobromide emulsion (containing 1.0 mol% silver bromide and 70 g/kg of silver) containing the blue-sensitive sensitizing dye shown below in an amount of $5.0\times10^{-4}$ mol per mol of silver was prepared. The above emulsified dispersion was mixed with the above silver halide emulsion and the composition for First Layer was prepared as shown below.

The coating compositions for Second Layer to Seventh were also prepared in essentially the same manner as above.

In this case, 1-oxy-3,5-dichloro-s-triazine sodium salt was used as a gelatin hardening agent for each layer.

In each layer, the following spectral sensitizing dye was used.

Blue-Sensitive Emulsion Layer:

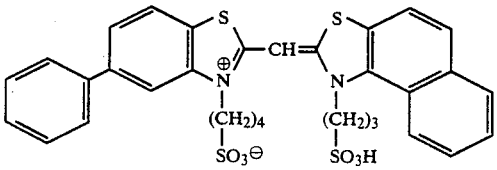

($5.0\times10^{-4}$ mol per mol of silver halide)

Green-Sensitive Emulsion Layer:

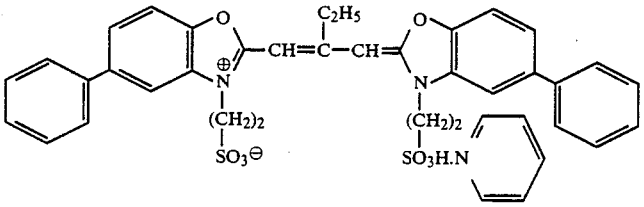

($4.0\times10^{-4}$ mol per mol of silver halide)

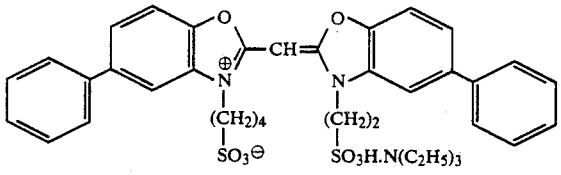

($7.0\times10^{-5}$ mol per mol of silver halide)

Red-Sensitive Emulsion Layer:

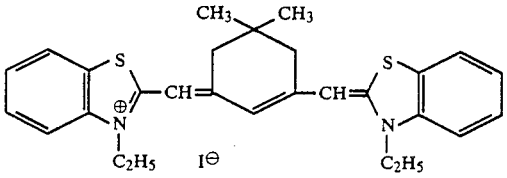

($0.9\times10^{-4}$ mol per mol of silver halide)

The following compound was also added to the red-sensitive emulsion layer in an amount of $2.6\times10^{-3}$ mol per mol of silver halide.

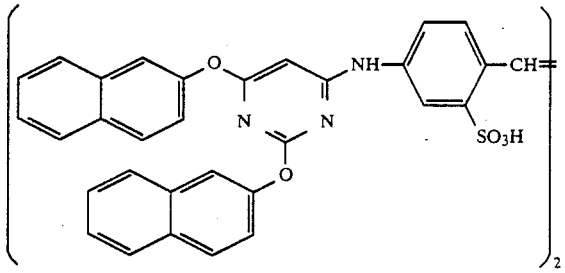

Further, 1-(5-methylureidophenyl)-5-mercaptotetrazole was added to each of the blue-sensitive emulsion layer, the green-sensitive emulsion layer, and the red-sensitive emulsion layer in an amount of $8.5\times10^{-5}$ mol, $7.7\times10^{-4}$ mol, or $2.5\times10^{-4}$ mol, respectively, per mol of silver halide.

Also, each emulsion layer contained the following dyes for irradiation prevention.

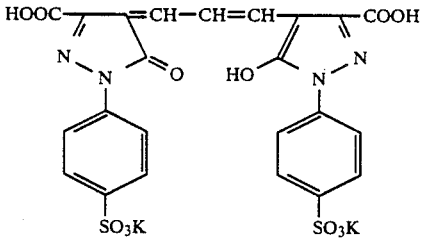

and

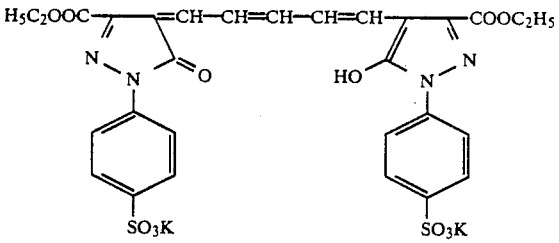

Layer Constitution

The composition of each layer was as shown below. The numerical values are coating amounts (g/m²) and as silver for silver halide emulsion layer.

The support was polyethylene-coated paper and the polyethylene layer at the emulsion layer side (i.e., at first layer side) contained $TiO_2$ as white pigment and ultramarine blue as a bluish dye.

| First Layer (Blue-Sensitive Emulsion Layer): | |
|---|---|
| Silver Halide Emulsion (Br: 1 mol %) | 0.30 |

-continued

| | |
|---|---|
| Gelatin | 1.86 |
| Yellow Coupler (ExY) | 0.82 |
| Color Image Stabilizer (Cpd - 1) | 0.19 |
| Solvent (Solv - 1) | 0.35 |
| Second Layer (Color Mixing Preventing Layer): | |
| Gelatin | 0.99 |
| Color Mixing Preventing Agent (Cpd - 2) | 0.08 |
| Layer 3 (Green-Sensitive Emulsion Layer): | |
| Silver Halide Emulsion (Br: 1 mol %) | 0.36 |
| Gelatin | 1.24 |
| Magenta Coupler (ExM) | 0.31 |
| Color Image Stabilizer (Cpd - 3) | 0.25 |
| Color Image Stabilizer (Cpd - 4) | 0.12 |
| Solvent (Solv - 2) | 0.42 |
| Layer 4 (Ultraviolet Absorbing Layer): | |
| Gelatin | 1.58 |
| Ultraviolet Absorbent (UV - 1) | 0.62 |
| Color Mixing Preventing Agent (Cpd - 5) | 0.05 |
| Solvent (Solv - 3) | 0.24 |

-continued

| | |
|---|---|
| Layer 5 (Red-Sensitive Emulsion Layer): | |
| Silver Halide Emulsion (Br: 1 mol %) | 0.23 |
| Gelatin | 1.34 |
| Cyan Coupler (ExC) | 0.34 |
| Color Image Stabilizer (Cpd - 6) | 0.17 |
| Polymer (Cpd - 7) | 0.40 |
| Solvent (Solv - 4) | 0.23 |
| Layer 6 (Ultraviolet Absorbing Layer): | |
| Gelatin | 0.53 |
| Ultraviolet Absorbent (UV -1) | 0.21 |
| Solvent (Solv - 3) | 0.08 |
| Layer 7 (Protective Layer): | |
| Gelatin | 1.33 |
| Acryl-Modified Copolymer of Polyvinyl Alcohol (modification degree of 17%) | 0.17 |
| Liquid Paraffin | 0.03 |

The compounds used for the color photographic paper were as follows.

(ExY) Yellow Coupler

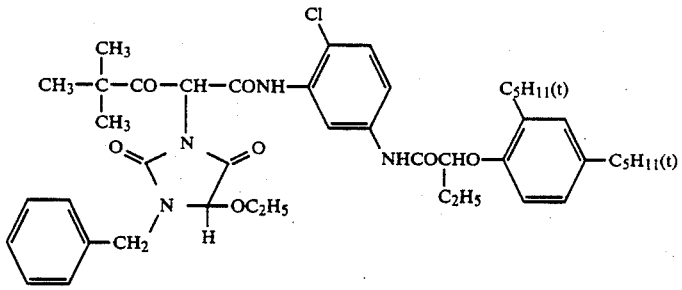

(ExM) Magenta Coupler

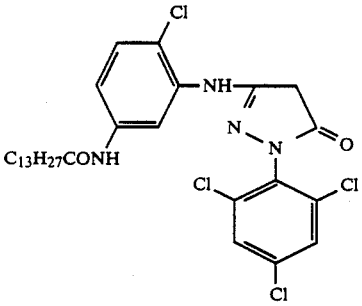

(ExC) CYan Coupler

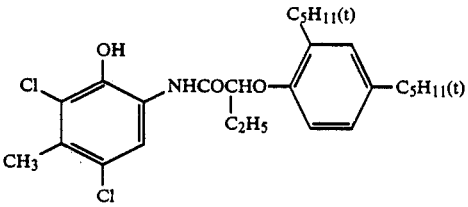

(Cpd-1) Color Image Stabilizer

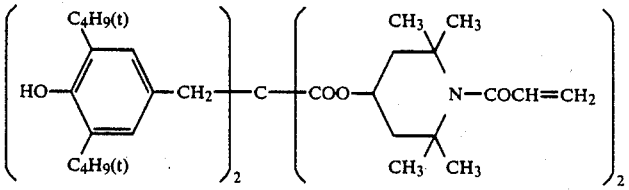

(Cpd-2) Colar Mixing Preventing Agent

-continued
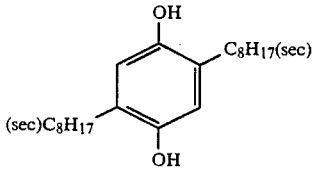
(Cpd-3) Color Image Stabilizer
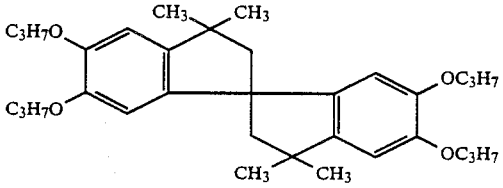
(Cpd-4) Color Image Stabilizer
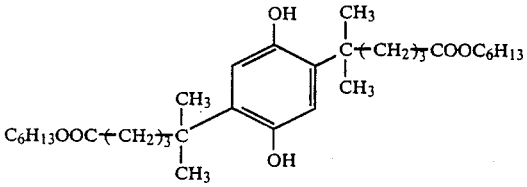
(Cpd-5) Color Mixing Preventing Agent
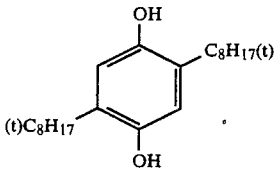
(Cpd-6) Color Image Stabilizer 5/8/9 mixture (wt ratio) of
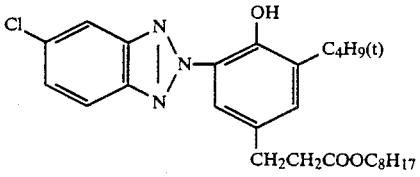
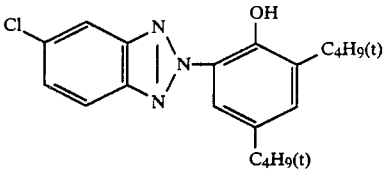
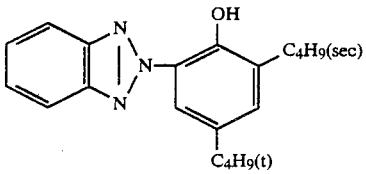
(Cpd-7) Polymer
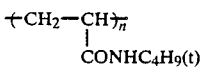
Average Molecular Weight: 80,000
(UV-1) Ultraviolet 2/9/8 Mixture (wt ratio) of -continued

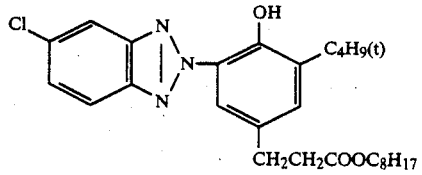

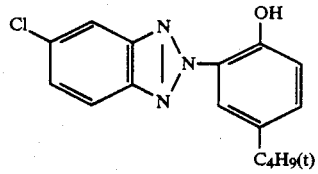

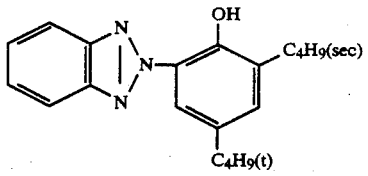

(Solv-1) Solvent

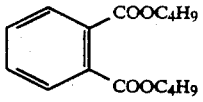

(Solv-2) Solvent 1/1 mixture (wt ratio) of

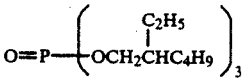

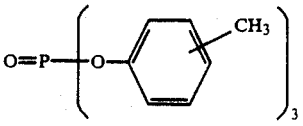

(Solv-3) Solvent
$O{=}P{-}(O{-}C_9H_{19}(iso))_3$ (Solv-4) Solvent

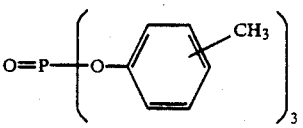

The color photographic paper thus prepared was wedge-exposed and processed by the following processing steps wherein the composition of the color development was changed.

| Processing Step | Temp. | Time | Replenisher Amount |
|---|---|---|---|
| Color Development | 35° C. | 45 sec. | 160 ml/m$^2$-light-sensitive material |
| Blixing | 35° C. | 45 sec. | 100 ml/m$^2$-light sensitive material |
| Stabilization 1 | 35° C. | 20 sec. | — |
| Stabilization 2 | 35° C. | 20 sec. | — |
| Stabilization 3 | 35° C. | 20 sec. | 200 ml/m$^2$-light-sensitive material |
| Drying | 80° C. | 60 sec. | — |

Stabilization was performed by a countercurrent system by supplying the replenisher for the stabilization solution from Stabilization tank 3 to Stabilization tank 1.

The compositions of the processing solutions used were as follows.

| Color Developer | Tank | Replenisher |
|---|---|---|
| Additive X' (shown in Table 2) | See Table 2 | |
| Benzyl Alcohol | See Table 2 (ml) | |
| Diethylene Glycol | See Table 2 (ml) | |
| Sodium Sulfite | See Table 2 | |
| Potassium Carbonate | 30 g | 30 g |
| Nitrilotriacetic Acid | 1 g | 1.5 g |
| 4-Amino-3-methyl-N-ethyl-N-{β-(methanesulfonamido)ethyl}-aniline Sulfate | 5.0 g | 7.0 g |
| Sodium Chloride | 1.5 g | 0.1 g |
| Brightening Agent (4,4'-diamino-stilbene series) | 3.0 g | 4.0 g |
| Water to make | 1 liter | 1 liter |
| pH | 10.05 | 10.50 |

Blixing Solution (Tank solution and the replenisher had same composition)

| | |
|---|---|
| Bleaching agent (shown in Table 2) | 0.15 mol |

-continued

| | |
|---|---|
| Chelating Agent (shown in Table 2) | 0.011 mol |
| Ammonium Thiosulfate (70 wt %) | 120 ml |
| Sodium Sulfite | 16 g |
| Glacial Acetic Acid | 7 g |
| Water to make | 1 liter |
| pH | 5.5 |

Stabilization Solution (Tank solution and the replenisher had same composition)

| | |
|---|---|
| Formalin (37 wt %) | 0.1 ml |
| 1-Hydroxyethylidene-1,1-diphosphonic Acid (60%) | 1.6 ml |
| Bismuth Chloride | 0.35 g |
| Aqueous Ammonia (26 wt %) | 2.5 ml |
| Nitrilotriacetic Acid.3Na | 1.0 g |
| Ethylenediaminetetraacetic Acid. $4H_2O$ (EDTA.4H) | 0.5 g |
| Sodium Sulfite | 1.0 g |
| 5-Chloro-2-methyl-4-isothiazolin-3-one | 50 mg |
| Water to make | 1 liter |

By following the same procedure as Example 1, the residual silver amount of the color photographic paper processed by each running solution was measured. Also, 1 liter of each running solution (color developer) was placed in a glass beaker so that the open ratio (the ratio of the contact area with air to the volume of the solution)was 0.12, the solution was allowed to stand for one week at 30° C., the evaporated amount of water was replenished by distilled water, and then the residual amount of the color developing agent was measured by liquid chromatography. The results obtained are shown in Table 2.

TABLE 2

| Test No. | Bleaching Agent | Chelating Agent | Benzyl Alcohol/ Diethylene Glycol: Tank Solution ml/l | Benzyl Alcohol/ Diethylene Glycol: Replenisher ml/l | Sodium Sulfite: Tank Solution g/l | Sodium Sulfite: Replenisher g/l | Additives X: Tank Solution 0.04 mol/l | Additives X: Replenisher 0.06 mol/l | Residual Silver Amount ($\mu g/cm^2$) | Residual Amount of Developing Agent (%) (*1) | |
|---|---|---|---|---|---|---|---|---|---|---|---|
| 2-1 | Nitrilotriacetic Iron (III) $NH_4$ | Nitrilotriacetic Acid | 15/10 | 20/10 | — | — | 1-2 | | 20.4 | 31 | Comparison |
| 2-2 | EDTA Iron (III) $NH_4$ | EDTA | 15/10 | 20/10 | — | — | " | | 19.8 | 29 | Comparison |
| 2-3 | Nitrilotriacetic Iron (III) $NH_4$ | Nitrilotriacetic Acid | — | — | — | — | " | | 18.8 | 35 | Comparison |
| 2-4 | EDTA Iron (III) $NH_4$ | EDTA | — | — | — | — | " | | 18.9 | 30 | Comparison |
| 2-5 | EDTA Iron (III) $NH_4$ | EDTA | — | — | 2 | 2.3 | " | | 20.0 | 71 | Comparison |
| 2-6 | (A-1) (*4) Iron (III) $NH_4$ | A - 1 (*4) | — | — | 2 | 2.3 | " | | 10.5 | 77 | Comparison |
| 2-7 | (*4) (A-1) Iron (III) $NH_4$ | A - 1 (*4) | 15/10 | 20/10 | — | — | I - 2 (*2) | | 5.3 | 90 | present invention |
| 2-8 | (*4) (A-2) Iron (III) $NH_4$ | A - 2 (*4) | 15/10 | 20/10 | — | — | I - 2 (*2) | | 4.8 | 92 | present invention |
| 2-9 | (*4) (A-1) Iron (III) $NH_4$ | A - 1 (*4) | — | — | — | — | I - 2 (*2) | | 1.9 | 95 | present invention |
| 2-10 | (*4) (A-2) Iron (III) $NH_4$ | A - 2 (*4) | — | — | — | — | I - 2 (*2) | | 2.1 | 94 | present invention |
| 2-11 | (*4) (A-2) Iron (III) $NH_4$ | A - 2 (*4) | — | — | — | — | II - 2 (*2) | | 2.9 | 92 | present invention |
| 2-12 | (*4) (A-2) Iron (III) $NH_4$ | A - 2 (*4) | — | — | — | — | III - 1 (*2) | | 2.8 | 90 | present invention |
| 2-13 | (*4) (A-2) Iron (III) $NH_4$ | A - 2 (*4) | — | — | — | — | IV - 2 (*2) | | 3.0 | 93 | present invention |
| 2-14 | (*4) (A-2) Iron (III) $NH_4$ | A - 2 (*4) | — | — | — | — | V - 2 (*2) | | 2.4 | 88 | present invention |
| 2-15 | (*4) (A-2) Iron (III) $NH_4$ | A - 3 (*4) | — | — | — | — | VI - 6 (*2) | | 2.4 | 89 | present invention |
| 2-16 | (*4) (A-3) Iron (III) $NH_4$ | A - 3 (*4) | — | | — | | VII - 2 (*3) | | 2.0 | 90 | present invention |
| 2-17 | (*4) (A-3) Iron (III) $NH_4$ | A - 3 (*4) | — | | — | | VIII - 2 (*3) | | 2.0 | 90 | present invention |
| 2-18 | (*4) (A-3) Iron (III) $NH_4$ | A - 3 (*4) | — | | — | | IX - 2 (*3) | | 2.1 | 88 | present invention |
| 2-19 | (*4) (A-3) Iron (III) $NH_4$ | A - 3 (*4) | — | | — | | X - 2 (*3) | | 2.1 | 89 | present invention |
| 2-20 | (*4) (A-7) Iron (III) $NH_4$ | A - 7 (*4) | — | | — | | XI - 2 (*3) | | 3.0 | 90 | present invention |
| 2-21 | (*4) (A-7) Iron (III) $NH_4$ | A - 7 (*4) | — | | — | | XII - 2 (*3) | | 4.0 | 90 | present invention |
| 2-22 | (*4) (A-7) Iron (III) $NH_4$ | A - 7 (*4) | — | | — | | XIII - 1 (*3) | | 3.8 | 90 | present invention |
| 2-23 | (*4) (A-7) Iron (III) $NH_4$ | A - 7 (*4) | — | | — | | XV - 2 (*3) | | 3.6 | 89 | present invention |
| 2-24 | (*4) (A-7) Iron (III) $NH_4$ | A - 7 (*4) | — | | — | | XV - 2 (*3) | | 3.5 | 88 | present invention |
| 2-25 | (*4) (A-7) Iron | A - 7 (*4) | — | | — | | XVI - 6 (*3) | | 2.1 | 98 | present |

TABLE 2-continued

| Test No. | Bleaching Agent | Chelating Agent | Benzyl Alcohol/ Diethylene Glycol Tank Solution ml/l | Benzyl Alcohol/ Diethylene Glycol Replenisher ml/l | Sodium Sulfite Tank Solution g/l | Sodium Sulfite Replenisher g/l | Additives X Tank Solution 0.04 mol/l | Additives X Replenisher 0.06 mol/l | Residual Silver Amount ($\mu g/cm^2$) | Residual Amount of Developing Agent (%) (*1) | |
|---|---|---|---|---|---|---|---|---|---|---|---|
| | (III) $NH_4$ | | | | | | | | | | invention |

(*1): Residual Amount of Developing aAgent is A/B × 100 (%): wherein A: Residual amount of color developing agent with the passage of time B: Amount of color developing agent immediately after running (*2): Test Nos. 2-7 to 2-15 contained further a processing solution using compound XVI-1 (0.04 mol/liter for the tank solution, 0.06 ml/liter for the replenisher) as additive X.

(*3): Test Nos. 2-16 2-25 contained further a processing solution using compound I-1 (0.04 mol/liter for the tank solution, 0.06 mol/liter for the replenisher) as additive x.

(*4): °A - 1: Diethylenetriaminepentaacetic Acid °A - 2: Cyclohexanediaminetetraacetic Acid °A - 3: Glycol Ether Diaminetetraacetic Acid °A - 7: 1,2-Diaminopropanetetraacetic Acid As is clear from the results shown in Table 2 above, the test cases of this invention using an aminopolycarboxylic acid having a molecular weight of 300 or more and containing no sulfite (Test Nos. 2-7 to 2-25) showed a lesser residual silver amount as compared to the comparison test cases using a chelating agent having a molecular weight of less than 300 (Test Nos. 2-1 to 2-5) and the comparison cases of where sulfite was present (Test Nos. 2-5 and 2-6). Also, it can be seen that the desilvering property is better in the case of no benzyl alcohol, being present (Test Nos. 2-9 and 2-10) than in the case of benzyl alcohol being present (Test Nos. 2-7 and 2-8). Further, it can also been seen that the residue of the color developing agent is better in the case of using Compound XVI - 1 (Test No. 2-9) than in the case of using a sulfite in place of the above compound (Test No. 2-6).

EXAMPLE 3

The same procedure as Example 1 was followed except that the compositions of the processing solutions and the processing steps were changed as follows using the sample 101 prepared in Example 1.

| Processing Step | Time | Temp. | Replenisher (*2) | Tank |
|---|---|---|---|---|
| Color Development | 2 min. 30 sec. | 40° C. | 10 ml | 8 liters |
| Blixing | 1 min. | 40° C. | 20 ml | 8 liters |
| Washing (1) | 20 sec. | 35° C. | (*1) | 2 liters |
| Washing (2) | 20 sec. | 35° C. | 10 ml | 2 liters |
| Stabilization | 20 sec. | 35° C. | 10 ml | 2 liters |
| Drying | 50 sec. | 65° C. | — | — |

(*1): Countercurrent flow system of from Wash tank (2) to Wash tank (1).
(*2): The amount of replenisher is per 35 mm × 1 meter.

The compositions of the processing solutions were as follows.

Color Developer

The same composition of the color developer as in Example 1 was used.

Blixing Solution (Tank solution and the replenisher had the same composiiton) (unit g)

| | |
|---|---|
| Bleaching Agent (shown in Table 1) | 0.25 mol |
| Chelating Agent (shown in Table 1) | 0.25 mol |
| Sodium Sulfite | 12.0 |
| Aqueous Solution of Ammonium Thiosulfate (70 Wt %) | 260.0 ml |
| Acetic Acid (98 Wt %) | 5.0 ml |
| Bleaching Accelerator | 0.01 mol |

-continued

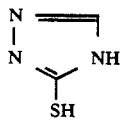

| | |
|---|---|
| Water to make | 1 liter |
| pH | 6.0 |

Washing Solution (Tank solution and the replenisher had the same composition)

City water was passed through a mixed bed system column packed with an H-type strong acid cation-exchange resin (Amberlite IR-120B, trade name, made by Rohm and Haas Co.) and an OH-type anion-exchange resin (Amberlite IR-400, trade name, made by the aforesaid company) to reduce the calcium and magnesium ion concentrations to less than 3 mg/liter, and then 20 mg/liter of sodium dichloroisocyanurate and 0.15 g/liter sodium sulfate were added thereto.

The pH of the solution was in the range of from 6.5 to 7.5.

Stabilization Solution (Tank solution and the replenisher had same composition) (unit: g)

| | |
|---|---|
| Formalin (37 wt %) | 2.0 ml |
| Polyoxyethylene-p-monononyl Phenyl Ether (mean polymerization degree: 10) | 0.3 |
| Ethylenediaminetetraacetic Acid Disodium Salt | 0.05 |
| Water to make | 1.0 liter |
| pH | 7.5 |

By using each running solution thus-obtained, the same exposure and processing as in Example 1 were carried out, and then residual silver amount was measured. The results show that when a bleaching agent having a molecular weight of 300 or more was used for the blixing solution and the color developer contained no sulfite, the amount of residual silver was greatly lessened.

EXAMPLE 4

A silver halide color photographic material as described in Example 4 of the specification of Japanese Patent Application No. 218627/86 was prepared.

The compositions of the processing solutions used were as follows.

| | Tank | Replenisher |
|---|---|---|
| Color Developer | | |
| Diethylenetriaminepentaacetic Acid | 1.0 g | 1.1 g |
| 1-Hydroxyethylidene-1,1-diphosphonic Acid | 2.0 g | 2.2 g |
| Sodium Sulfite | See Table 3 | |
| Potassium Carbonate | 30.0 g | 32.0 g |
| Potassium Bromide | 1.4 g | 0.7 g |
| Potassium Iodide | 1.3 mg | — |
| 4-(N-Ethyl-N-β-hydroxyethylamino)-2-methylaniline Sulfate | 4.5 g | 5.0 g |
| Water to make | 1.0 liter | 1 liter |
| pH | 10.0 | 10.5 |
| Bleaching Solution | | |
| Bleaching Agent (shown in TABLE 3) | 0.25 ml | 0.275 mol |
| Chelating Agent (shown in TABLE 3) | 0.025 ml | 0.0275 mol |
| Aqueous Ammonia (28 wt %) | 7 ml | 5 ml |
| Ammonium Nitrate | 10.0 g | 12.0 g |
| Ammonium Bromide | 150 g | 170 g |
| Water to make | 1.0 l | 1.0 l |
| pH | 6.0 | 5.8 |
| Fixing Solution | | |
| Ethylenediaminetetraacetic Acid Di-sodium Salt | 1.0 g | 1.2 g |
| Sodium Sulfite | 4.0 g | 5.0 g |
| Sodium Hydrogen Sulfite | 4.4 g | 5.8 g |
| Aqueous Solution of Ammonium Thiosulfate (70 wt %) | 175 ml | 200 ml |
| Water to make | 1.0 liter | 1.0 liter |
| pH | 6.6 | 6.6 |
| Stabilizing Solution | | |
| Formalin (37 wt %) | 2.0 ml | 2.0 ml |
| Polyoxyethylene-p-monononyl-phenylether (average polymerization degree: 10) | 0.3 g | 0.3 g |
| Ethylenediaminetetraacetic Acid Di-sodium Salt | 0.05 g | 0.05 g |
| Water to make | 1.0 liter | 1.0 liter |
| pH | 7.5 | 7.5 |

After adjusting a light-exposure for a silver halide color photographic material as described above so that the amount of a developed silver obtained in the color photographic material samples for each running solution each becomes same, the color photographic material samples was processed according to the following processing steps, and the residual silver amount was measured by the fluorescent X ray analysis method.

| Step | Temp. | Time | Tank Amount | Replenisher Amount (per 35 mm × 1 meter) |
|---|---|---|---|---|
| Color Development | 38° C. | 3 min. and 15 sec. | 8 l | 15 ml |
| Bleaching | 38° C. | 6 min. and 30 sec. | 8 l | 5 ml |
| Fixing | 38° C. | 4 min. | 8 l | 30 ml |
| Rinse (1)* | 38° C. | 30 sec. | 4 l | — |
| Rinse (2)* | 38° C. | 30 sec. | 4 l | — |
| Rinse (3)* | 38° C. | 30 sec. | 4 l | 30 ml |
| Drying | 50° C. | 1 min. and 30 sec. | — | |

The results thus-obtained are shown in Table 3 below.

TABLE 3

| Test No. | Bleaching Agent | Chelating Agent | Compound X (0.05 mol/l) | Sodium sulfite Tank Solution/ Replenisher (g/l / g/l) | Residual Silver Amount (μg/cm²) | |
|---|---|---|---|---|---|---|
| 3 - 1 | Nitrilotriacetic Acid Iron (III) $NH_4$ | Nitrilotriacetic Acid | I - 9 | 4.0/4.4 | 60 | Comparison |
| 3 - 2 | Ethylenediamine-N,N'-diacetic Acid Iron (III) $NH_4$ | Ethylenediamine-N,N'-diacetic Acid | " | 4.0/4.4 | 45 | Comparison |
| 3 - 3 | EDTA Iron (III) $NH_4$ | EDTA | " | 4/0/4.4 | 40 | Comparison |
| 3 - 4 | (*2)(A-1) Iron (II) $NH_4$ | A - 1(*2) | " | 4.0/4.4 | 21 | Comparison |
| 3 - 5 | (*2)(A-2) Iron (III) $NH_4$ | A - 2(*2) | " | 4.0/4.4 | 19 | Comparison |
| 3 - 6 | (*2)(A-3) Iron (III) $NH_4$ | A - 3(*2) | " | 4.0/4.4 | 21 | Comparison |
| 3 - 7 | Nitrilotriacetic Acid Iron (III) $NH_4$ | Nitrilotriacetic Acid | " | 0 | 59 | Comparison |
| 3 - 8 | Ethylenediamine-N,N'-diacetic Acid Iron (III) $NH_4$ | Ethylenediamine-N,N'-diacetic Acid | " | 0 | 50 | Comparison |
| 3 - 9 | EDTA Iron (III) $NH_4$ | EDT | " | 0 | 42 | Comparison |
| 3 - 10 | (*2)(A-1) Iron $NH_4$ (A-1) Iron $NH_4$ | A - 1(*2) | " | 0 | 1.5 | Present invention |
| 3 - 11 | (*2)(A-2) Iron $NH_4$ | A - 2(*2) | " | 0 | 2.0 | Present invention |
| 3 - 12 | (*2)(A-3) Iron $NH_4$ | A - 3(*2) | " | 0 | 2.0 | Present invention |
| 3 - 13 | (*2)(A-4) Iron $NH_4$ | A - 4(*2) | " | 0 | 1.9 | Present invention |
| 3 - 14 | (*2)(A-4) Iron $NH_4$ | A - 4(*2) | I - 1 | 0 | 1.9 | Present invention |
| 3 - 15 | (*2)(A-4) Iron $NH_4$ | A - 4(*2) | II - 1 | 0 | 2.2 | Present invention |
| 3 - 16 | (*2)(A-4) Iron $NH_4$ | A - 4(*2) | III - 11 | 0 | 2.2 | Present invention |
| 3 - 17 | (*2)(A-4) Iron $NH_4$ | A - 4(*2) | IV - 3 | 0 | 1.9 | Present invention |
| 3 - 18 | (*2)(A-4) Iron $NH_4$ | A - 4(*2) | V - 1 | 0 | 1.9 | Present invention |
| 3 - 19 | (*2)(A-4) Iron $NH_4$ | A - 4(*2) | VI - 5 | 0 | 2.3 | Present invention |
| 3 - 20 | (*2)(A-4) Iron $NH_4$ | A - 4(*2) | VII-1(*1) | 0 | 2.3 | Present |

TABLE 3-continued

| Test No. | Bleaching Agent | Chelating Agent | Compound X (0.05 mol/l) | Sodium sulfite Tank Solution/ Replenisher (g/l / g/l) | Residual Silver Amount (μg/cm²) | |
|---|---|---|---|---|---|---|
| 3 - 21 | (*2)(A-4) Iron $NH_4$ | A - 4(*2) | VIII - 1(*1) | 0 | 1.9 | Present invention |
| 3 - 22 | (*2)(A-4) Iron $NH_4$ | A - 4(*2) | IX - 1(*1) | 0 | 2.0 | Present invention |
| 3 - 23 | (*2)(A-4) Iron $NH_4$ | A - 4(*2) | X - 1(*1) | 0 | 2.2 | Present invention |
| 3 - 24 | (*2)(A-4) Iron $NH_4$ | A - 4(*2) | XI - 1(*1) | 0 | 2.1 | Present invention |
| 3 - 25 | (*2)(A-4) Iron $NH_4$ | A - 4(*2) | XII - 1(*1) | 0 | 2.3 | Present invention |
| 3 - 26 | (*2)(A-4) Iron $NH_4$ | A - 4(*2) | XIII - 1(*1) | 0 | 2.0 | Present invention |
| 3 - 27 | (*2)(A-4) Iron $NH_4$ | A - 4(*2) | XIV - 1(*1) | 0 | 2.1 | Present invention |
| 3 - 28 | (*2)(A-4) Iron $NH_4$ | A - 4(*2) | XV - 1(*1) | 0 | 2.2 | Present invention |
| 3 - 29 | (*2)(A-4) Iron $NH_4$ | A - 4(*2) | XVI - 1(*1) | 0 | 2.2 | Present invention |

(*1)Test Nos. 3-20 to 3-29 contained further Compound I-1 (i.e., hydroxyamines of this invention) as Compound X of Table 3 in an amount of 0.05 mol/l.
(*2)A - 1: Diethylenetriaminepentaacetic Acid A - 2: Cyclohexanediaminetetraacetic Acid A - 3: Glycol Ether Diaminetetraacetic Acid A - 4: 1,3-Diaminopropanetetraacetic Acid As is clear from the results shown in Table 3 above, according to the process of this invention, the good results can be obtained.

While the invention has been described in detail and with reference to specific embodiments thereof, it will be apparent to one skilled in the art that various changes and modifications can be made therein without departing from the spirit and scope thereof.

We claim:

1. A method for processing a silver halide color photographic material, which comprises processing a silver halide color photographic material with a color developer containing from 0 to 0.005 mol of sulfite ion per liter of developing solution and then processing the color photographic material with a solution having bleaching capability containing an aminopolycarboxylic acid having a molecular weight of at least 300, wherein said color developer contains a compound represented by formula (I) or (III):

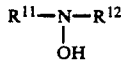

(I)

wherein $R^{11}$ and $R^{12}$ each represents a substituted alkyl group, a substituted alkenyl group, a substituted aryl group, or a heteroaromatic group, and the substituent for said substituted group represents at least one group selected from the group consisting of a hydroxyl group, an alkoxy group, an alkylsulfonyl group, an arylsulfonyl group, an amide group, a carboxyl group, a cyano group, a sulfo group, a nitro group and an amino group;

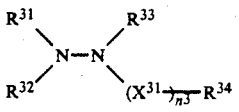

(III)

wherein $R^{31}$, $R^{32}$ and $R^{33}$ each represents a hydrogen atom, a substituted or unsubstituted alkyl group, a substituted or unsubstituted aryl group or a substituted or unsubstituted heterocyclic group; $R^{34}$ represents a hydroxyl group, a hydroxyamino group, a substituted or unsubstituted alkyl group, a substituted or unsubstituted aryl group, a substituted or unsubstituted heterocyclic group, a substituted or unsubstituted alkoxy group, a substituted or unsubstituted aryloxy group, a substituted or unsubstituted carbamoyl group, or a substituted or unsubstituted amino group; $X^{31}$ represents —CO—, —$SO_2$—, or

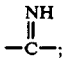

and $n^3$ represents 0 or 1.

2. The method for processing silver halide color photographic material as claimed in claim 1, wherein the aminopolycarboxylic acid having a molecular weight of at least 300 is selected from the group consisting of Diethylenetriaminepentaacetic Acid,
Cyclohexanediaminetetraacetic Acid,
Glycol Ether Diaminetetraacetic Acid,
1,3-Diaminopropanetetraacetic Acid,
Diaminopropanolpentaacetic Acid,
Ethylenediainediortho-hydroxyphenylacetic Acid,
1,2-Diaminopropanetetraacetic Acid, and
Triethylenetetraminehexaacetic Acid.

3. The method for processing silver halide color photographic material as claimed in claim 1, wherein the aminopolycarboxylic acid having a molecular weight of at least 300 is selected from the group consisting of 1,3-Diaminopropanetetraacetic acid, cyclohexanediaminetetraacetic acid, glycol ether diaminetetraacetic acid, and 1,2-Diaminopropanetetraacetic acid.

4. The method for processing silver halide color photographic material as claimed in claim 1, wherein the color developer contains an organic preservative.

5. The method for processing silver halide color photographic material as claimed in claim 4, wherein the organic preservative is at least one compound selected from the group consisting of hydroxylamines hydroxamic acids, hydrazines, hydrazides, phenols, α-hydroxyketones, α-aminoketones, saccharide, monoamines, diamines, polyamines, quaternary ammonium salts, nitroxyradicals, alcohols, oximes, diamide compounds, condensed cyclic amines.

6. The method for processing silver halide color photographic material as claimed in claim 1, wherein the molecular weight of the aminopolycarboxylic acid is from 300 to 800.

7. The method for processing silver halide color photographic material as claimed in claim 1, wherein the molecular weight of the aminopolycarboxylic acid is from 300 to 400.

8. The method for processing silver halide color photographic material as claimed in claim 1, wherein the color developer contains 5.0 ml or less of benzyl alcohol per liter of the color developer.

9. The method for processing a silver halide color photographic material as claimed in claim 1, wherein $R^{11}$ and $R^{12}$ each represents a substituted alkyl group, a substituted alkenyl group or a substituted aryl group.

10. The method for processing a silver halide color photographic material as claimed in claim 1, wherein $R^{11}$ and $R^{12}$ each represents an alkyl group or an alkenyl group and the carbon atom number for $R^{11}$ and $R^{12}$ is from 1 to 10.

11. The method for processing a silver halide color photographic material as claimed in claim 1, wherein the substituent for $R^{31}$, $R^{32}$, $R^{33}$ and $R^{34}$ each represents at least one group selected from the group consisting of a —OH group, a —COOH group and a $—SO_3H$ group.

12. The method for processing a silver halide color photographic material as claimed in claim 1, wherein $R^{31}$, $R^{32}$ and $R^{33}$ each represents a hydrogen atom or an alkyl group; $R^{34}$ represents an alkyl group, an aryl group, an alkoxy group, a carbamoyl group or an amino group; and $X^{31}$ represents —CO— or $—SO_2—$.

* * * * *